US012098551B2

(12) United States Patent
Gori et al.

(10) Patent No.: US 12,098,551 B2
(45) Date of Patent: Sep. 24, 2024

(54) MODULAR ASSEMBLIES FOR GUTTER GUARD SYSTEMS WITH CUSTOMIZABLE MAIN BODIES

(71) Applicant: LeafFilter North, LLC, Hudson, OH (US)

(72) Inventors: Michael Gori, Norton, OH (US); Jason A. Crowell, Akron, OH (US)

( * ) Notice: Subject to any disclaimer, the term of this patent is extended or adjusted under 35 U.S.C. 154(b) by 0 days.

(21) Appl. No.: 17/933,698

(22) Filed: Sep. 20, 2022

(65) Prior Publication Data

US 2024/0093500 A1 Mar. 21, 2024

(51) Int. Cl.
*E04D 13/076* (2006.01)

(52) U.S. Cl.
CPC ..... *E04D 13/076* (2013.01)

(58) Field of Classification Search
CPC ..... E04D 13/076; E04D 13/0765; E04D 13/064; E04D 13/0445; E04D 13/0725
See application file for complete search history.

(56) References Cited

U.S. PATENT DOCUMENTS 486,868 A * 11/1892 Gogerty ..... E04D 13/076 52/12
1,349,264 A * 8/1920 Busse ..... E04D 13/076 248/48.1
1,526,821 A * 2/1925 Andrews ..... E04D 13/076 52/12
9,127,463 B1 * 9/2015 Feldhaus ..... E04D 13/076
10,655,334 B2 * 5/2020 Gori ..... E04D 13/076
2006/0053697 A1 * 3/2006 Higginbotham ..... E04D 13/076 52/12
2006/0123710 A1 * 6/2006 Lenney ..... E04D 13/076 52/12
2006/0179723 A1 * 8/2006 Robins ..... E04D 13/076 52/11
2011/0067318 A1 * 3/2011 Lenney ..... E04D 13/076 52/12
2011/0272344 A1 * 11/2011 Higginbotham ..... E04D 13/076 210/494.1
2012/0132759 A1 * 5/2012 Sager ..... E04D 13/0762 248/49
2013/0160377 A1 * 6/2013 Sager ..... E04D 13/076 52/12

(Continued)

*Primary Examiner* — Babajide A Demuren
(74) *Attorney, Agent, or Firm* — Benesch Friedlander Coplan & Aronoff LLP

(57) ABSTRACT

Disclosed and described herein are components for configuring and assembling gutter guard systems for trough-style and built-in gutter systems. Such gutter guard systems are designed and arranged to be positioned across the opening of a trough or box gutter to prevent debris from entering the rain gutter. The modular assembly includes a number of configurable components. In one embodiment, a gutter guard system includes a customizable main body, a mesh screen, a front receiver, and a rear receiver. The customizable main body includes a top surface, a bottom surface, a front edge, and a rear edge, and the main body is arranged to be trimmed to custom dimensions. Once assembled, the mesh screen is positioned on the top surface of the main body, the front receiver is positioned along the front edge of the main body, and the rear receiver is positioned along the rear edge of the main body.

27 Claims, 24 Drawing Sheets

(56) References Cited

U.S. PATENT DOCUMENTS

| | | | | |
|---|---|---|---|---|
| 2013/0276378 | A1* | 10/2013 | McCoy | E04D 13/076 52/12 |
| 2014/0215929 | A1* | 8/2014 | Lenney | E04D 13/0725 52/12 |
| 2015/0143756 | A1* | 5/2015 | Higginbotham | E04D 13/076 52/12 |
| 2017/0089071 | A1* | 3/2017 | Smith | E04D 13/076 |
| 2018/0216348 | A1* | 8/2018 | Morris | F16B 2/243 |
| 2019/0218784 | A1* | 7/2019 | Gori | E04D 13/076 |
| 2019/0330851 | A1* | 10/2019 | Gori | E04D 13/072 |
| 2020/0040583 | A1* | 2/2020 | Gori | E04D 13/076 |
| 2020/0308839 | A1* | 10/2020 | Neeb | E04D 13/068 |
| 2020/0347606 | A1* | 11/2020 | Lenney | E04D 13/068 |
| 2020/0378128 | A1* | 12/2020 | Iannelli | B01D 39/12 |

* cited by examiner

MODULAR ASSEMBLIES FOR GUTTER GUARD SYSTEMS WITH CUSTOMIZABLE MAIN BODIES

FIELD OF INVENTION

The present disclosure generally relates to systems and methods for preventing debris from entering rain gutters while optimizing water flow and infusion into the rain gutter. More specifically, the present disclosure relates to modular assemblies for gutter guard systems with components that can be assembled to form a gutter guard system with customizable dimensions to accommodate a variety of roof and gutter configurations.

BACKGROUND

Rain gutter systems are commonly used for residential homes, buildings, and other structures to manage rainwater by collecting the rainwater and channeling that rainwater away from the structure. Such management of rainwater can be critical for the overall maintenance and condition of the structure by reducing or eliminating damage to the structure and its foundation that can be caused by the uncontrolled flow of rainwater. Gutter guards are components or systems that are typically attached to or incorporated into rain gutters to prevent leaves, pine needles, branches, soot, and other such debris from entering the rain gutter. Such debris can clog the rain gutter and reduce its effectiveness in channeling rainwater away from a residential home, building, or other structure. In addition, such debris can damage and shorten the service life of a rain gutter system by causing corrosion, pitting, or other deleterious effects on the rain gutter system. Unfortunately, prior art gutter guard systems do not effectively channel water away from a structure. Inefficient water management designs, matting of debris onto the gutter guard system over time, and ill-fitting gutter guard systems cause unnecessary damage to homes and other structures, which reduces property values, increases maintenance costs, and causes dangerous conditions for occupants of structures.

Gutter guards are typically manufactured to fit a specific style and specific size of rain gutter. Such gutter guards are typically manufactured as a single component or assembly of subcomponents, where the subcomponents are irreversibly joined together. Thus, gutter guard manufacturers, distributors, and/or dealers typically choose between making and/or stocking a limited number of products that accommodate a limited segment of the market or making and/or stocking a large number of products to accommodate the large number of variations of rain gutter guards.

There are many different sizes and styles of rain gutters on the market in the United States and internationally. the differences in rain gutter sizes and styles are driven by a number of factors including different architectural styles for homes and buildings in different geographical regions and regional homebuilder and contractor trade practices that develop over time. Such different architectural styles can also be driven by differences in climate and weather patterns (for example, volume of annual rain and snow fall), historic influences, availability of building materials, and so on. The different architectural styles often dictate the rooflines of structures, which in large part dictates the style and size of rain gutters and how the rain gutter is attached to the structure/roofline. The term "structure" is used herein generically to mean residential homes, multi-residential buildings, office buildings, warehouses, commercial buildings, or any other structures for which rain gutter systems are used to channel rainwater away from the structure. The term "roofline" is used herein generically to mean the intersection of the underside of the roof of a structure with the exterior walls of the structure and/or other proximal exterior features such as rafter tails, fascia board, starter strips, flashing, drip edges, and so on. Once a particular style of rain gutter becomes dominant in a region or market, the regional or local homebuilder and contractor trade practices are heavily influenced by the dominant rain gutter style and homebuilders and installation contractors become accustomed to installing that rain gutter style, thus reinforcing the dominance of the rain gutter style in the geographic region. The particular size of this dominant style gutter is variable due to considerations such as the surface area of the roof of a specific structure and regional architectural influences.

As will be appreciated from the following discussion, the number of variations in types of rain gutters, sizes of rain gutters, mechanisms for securing rain gutters to structures and/or rooflines, etc. creates a plethora of potential combinations of rain gutter arrangements. Thus, designing a generic gutter guard product to accommodate such a large number of potential combinations is a challenge that has yet to be met in the marketplace.

Of the various styles of rain gutters, trough-style and built-in gutter systems present unique problems for manufacturers and distributors of gutter guards. Generally, a trough-style gutter system is a gutter system that is integrally incorporated into a roof of a house or other structure. Trough-style gutter systems are incorporated into the roof above the roofline and are often formed from flashing and other common roofing materials. FIGS. 1-3 are photographs of such trough-style gutter systems. As is illustrated in the figures, a trough-style gutter system 10 includes a trough 12 that extends from the edge of the roofing material 14 (in this example, the edge of the asphalt shingles) to the roofline. The trough is formed by the declining surface of the roof and one or more vertical walls 16 extending upward at the roofline. Within the trough 12 there is one or more apertures 18 that are couple to downspouts (not shown) through which rainwater flows to exit the trough 12. As shown in FIGS. 1-3, the vertical walls 16 can be in part made from flashing material, along with other structural components. The trough 12 can include a lining material such as rubber sheeting or tar paper that assist the rainwater in flowing through the trough 12.

FIG. 4 schematically illustrates an exemplary built-in gutter system 20 in cross-section. Built-in gutter systems 20 are often referred to as box gutter systems. Built-in gutter systems are similar to trough-style gutter systems but includes a separately fabricated "box gutter" that is incorporated into the roof near the roofline. As illustrated is FIG. 4, a built-in box gutter 22 is positioned in a recession formed in the roof near the roofline just below the edge of the roofing material 24. The box gutter 22 includes a downward extending pipe 26 that forms a pathway for rainwater to flow out of the box gutter 22. The downward extension 26 is coupled to a downspout 28 that channels rainwater away from the structure.

Both the trough-style and built-in gutter systems are prone to issues of debris collection in the trough or box gutter and the clogging issues that result from such debris collection. Additionally, for trough-style gutters, the lining material (rubber sheeting, tar paper, etc.) discussed above functions to protect the structure from water damage. Debris interacting with this lining material can puncture or otherwise damage the lining material, which can result in water passing through the lining material and damages the structure. Thus, both the trough-style and built-in gutter systems can greatly benefit from the installation of gutter guard systems. However, as will be appreciated, all trough-style gutter systems are custom built and do not adhere to any general standards of design, size, or dimensions. Additionally, built-in gutter systems also include significant customization in general design that facilitates installation of the system into a roof. Thus, built-in gutter systems also do not adhere to standard sizing and dimensions. It will be appreciated that with such diversity in design, size, and dimensions, it is difficult to anticipate the specific requirements and/or challenges for installing a gutter guard system in trough-style or built-in gutter systems because of the unpredictability of the design, size, and dimensions. Because of the variety of requirements, there are no current gutter guard products that are applicable to trough-style and built-in gutter systems.

Therefore, there is a need for gutter guard systems and/or methods of installation for gutter guard protection to accommodate trough-style and built-in gutter systems. Disclosed herein are novel gutter guard systems and methods of installing those gutter guard systems that accommodate trough-style and built-in gutter systems.

SUMMARY

A variety of components for configuring and assembling gutter guard systems for trough-style and built-in gutter systems is disclosed and claimed herein. Such gutter guard systems are designed and arranged to be positioned across the opening of a trough or box gutter to prevent debris from entering the rain gutter. The modular assembly includes a number of configurable components. Select modular components can be customized to create assemblies that form a gutter guard system for use with a specific trough-style or built-in gutter system based on the trough-style or built-in gutter system's design, size and/or dimensions. One such customizable component is a main body. The main body can be dimensionally customized to accommodate varying designs of trough-style and built-in gutter systems and sizes of associated troughs and box gutters.

In one embodiment, a gutter guard system includes a customizable main body, a mesh screen, a front receiver, and a rear receiver. The customizable main body includes a top surface, a bottom surface, a front edge, and a rear edge, and the main body is arranged to be trimmed to custom dimensions. Once assembled, the mesh screen is positioned on the top surface of the main body, the front receiver is positioned along the front edge of the main body, and the rear receiver is positioned along the rear edge of the main body. The main body is constructed from a plurality of metal rods arranged in a lattice structure, where the metal rods can be welded together and spaced approximately one inch apart. The mesh screen is constructed from a plurality of threads woven into a lattice structure, where the threads are made from 316L stainless steel wire with a diameter of approximately 0.0085 inches. The threads are arranged in the lattice such that there are approximately 30 threads per linear inch in both directions of the lattice. This results in a mesh screen with an open area of approximately fifty-five percent.

In an embodiment, the front receiver includes an upper member running the length of the front receiver, a lower member running the length of the front receiver, a connecting member connecting the upper member and lower member, and a leg extending downward from the upper member. A channel is formed by the upper member, lower member, connecting member, and the leg. Once assembled with the main body, the front edge of the main body is positioned in the channel. In one example, the front edge of the main body is engaged in a friction fit with the channel. The front receive can be arranged such that the upper member comprises a forward section and a rearward section, wherein the forward section extends at a downward angle from the rearward section.

In an embodiment, the rear receiver includes an upper member running the length of the rear receiver, a lower member running the length of the rear receiver, a connecting member connecting the upper member and lower member, and a leg extending downward from the upper member. A channel is formed by the upper member, lower member, connecting member, and the leg. Once assembled with the main body, the rear edge of the main body is positioned in the channel. In one example, the rear edge of the main body is engaged in a friction fit with the channel. The rear receive can be arranged such that the upper member comprises a forward section and a rearward section, wherein the rearward section extends at an upward angle from the forward section.

In one example, the dimensions of the gutter guard system can be customized by trimming the main body along a line that is generally parallel to the front edge and rear edge of the main body. In another example, the dimensions of the gutter guard system can be customized by trimming the main body along a line that is generally at an angle to the front edge and rear edge of the main body, for example, a forty-five degree angle.

BRIEF DESCRIPTION OF THE DRAWINGS

In the accompanying drawings, structures are illustrated that, together with the detailed description provided below, describe example embodiments of the disclosed systems, methods, and apparatus. Where appropriate, like elements are identified with the same or similar reference numerals. Elements shown as a single component can be replaced with multiple components. Elements shown as multiple components can be replaced with a single component. The drawings may not be to scale. The proportion of certain elements may be exaggerated for the purpose of illustration.

DETAILED DESCRIPTION

The apparatus, systems, arrangements, and methods disclosed in this document are described in detail by way of examples and with reference to the figures. It will be appreciated that modifications to disclosed and described examples, arrangements, configurations, components, elements, apparatus, methods, materials, etc. can be made and may be desired for a specific application. In this disclosure, any identification of specific techniques, arrangements, method, etc. are either related to a specific example presented or are merely a general description of such a technique, arrangement, method, etc. Identifications of specific details or examples are not intended to be and should not be construed as mandatory or limiting unless specifically designated as such. Selected examples of modular assembles that include a number of customizable components that can be assembled to form gutter guard systems for use with trough-style gutter and built-in gutter systems are hereinafter disclosed and described in detail with reference made to FIGS. 1-24.

As will be described in detail herein, an embodiment of a novel gutter guard system includes four main components: a main body, a mesh screen, a front receiver, and a rear receiver. Such components can be customized and assembled to form a gutter guard system and subsequently positioned proximate to the top opening of a trough of a trough-style gutter system or proximate to the top opening of a box gutter of a built-in gutter system to provide such gutter systems with protection against debris and other unwanted materials from entering the gutter system.

Figure 1:
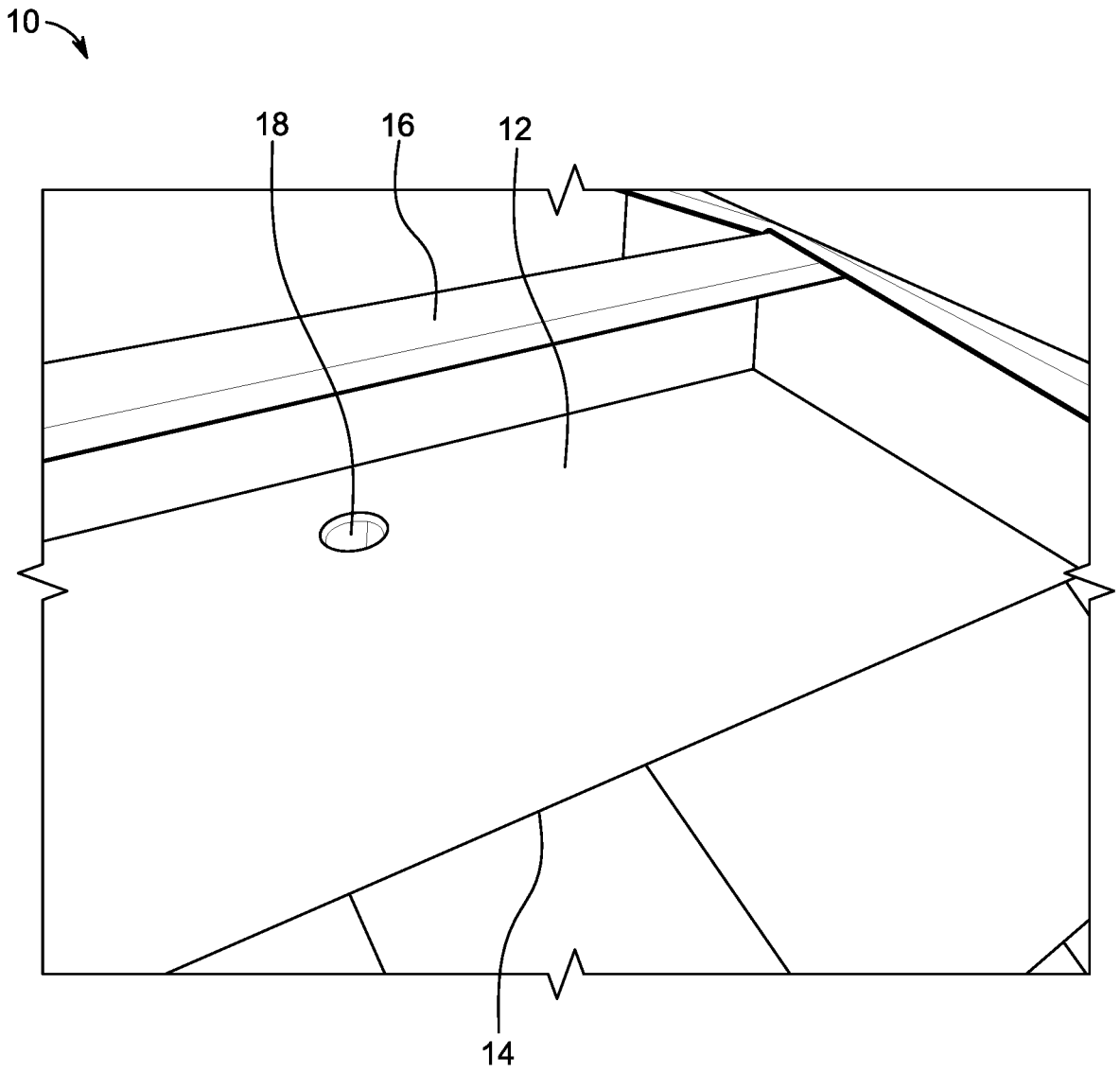
FIG. 1 is a photograph of an exemplary trough-style gutter system.
Figure 2:
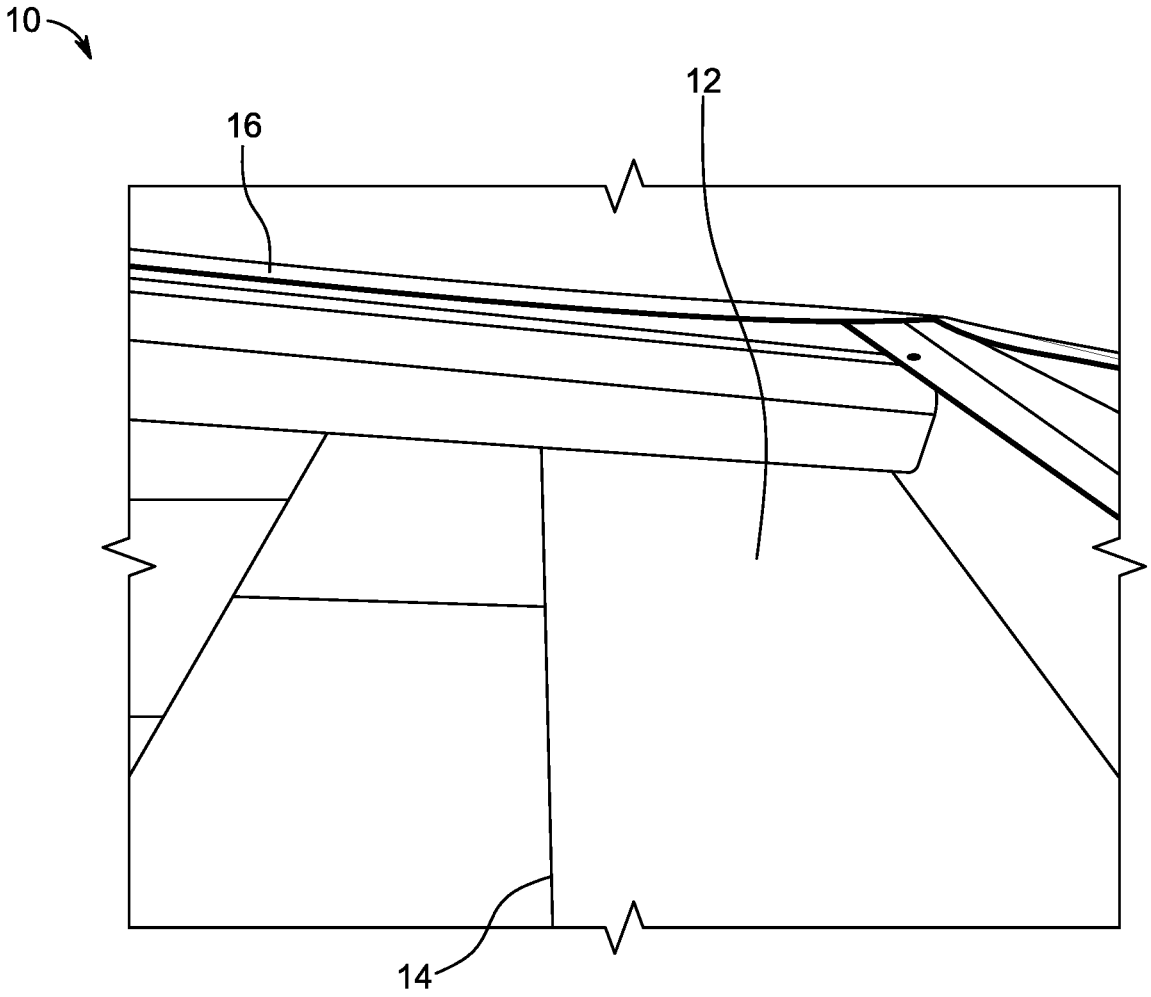
FIG. 2 is another photograph of an exemplary trough-style gutter system.
Figure 3:
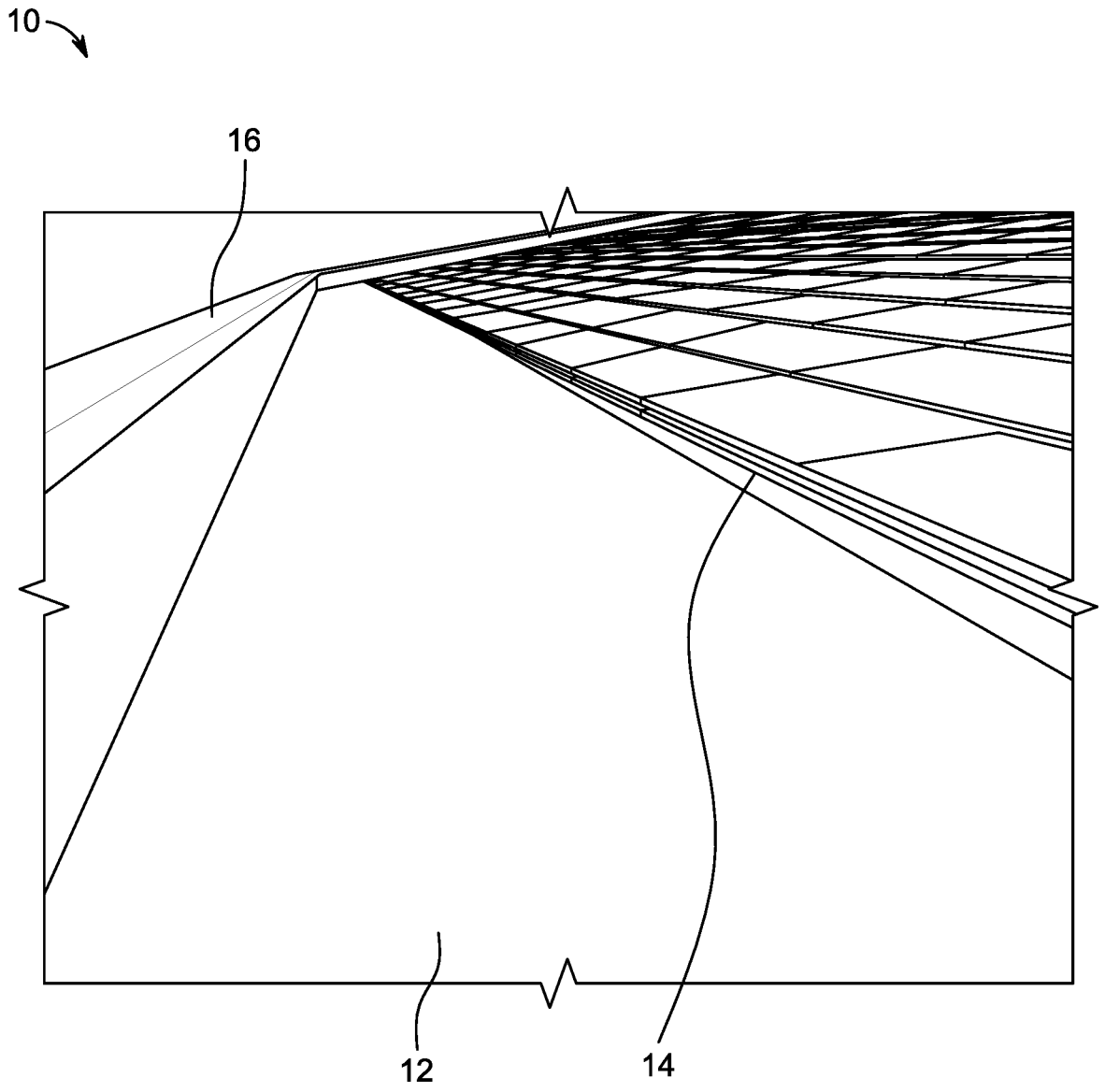
FIG. 3 is another photograph of an exemplary trough-style gutter system.
Figure 4:
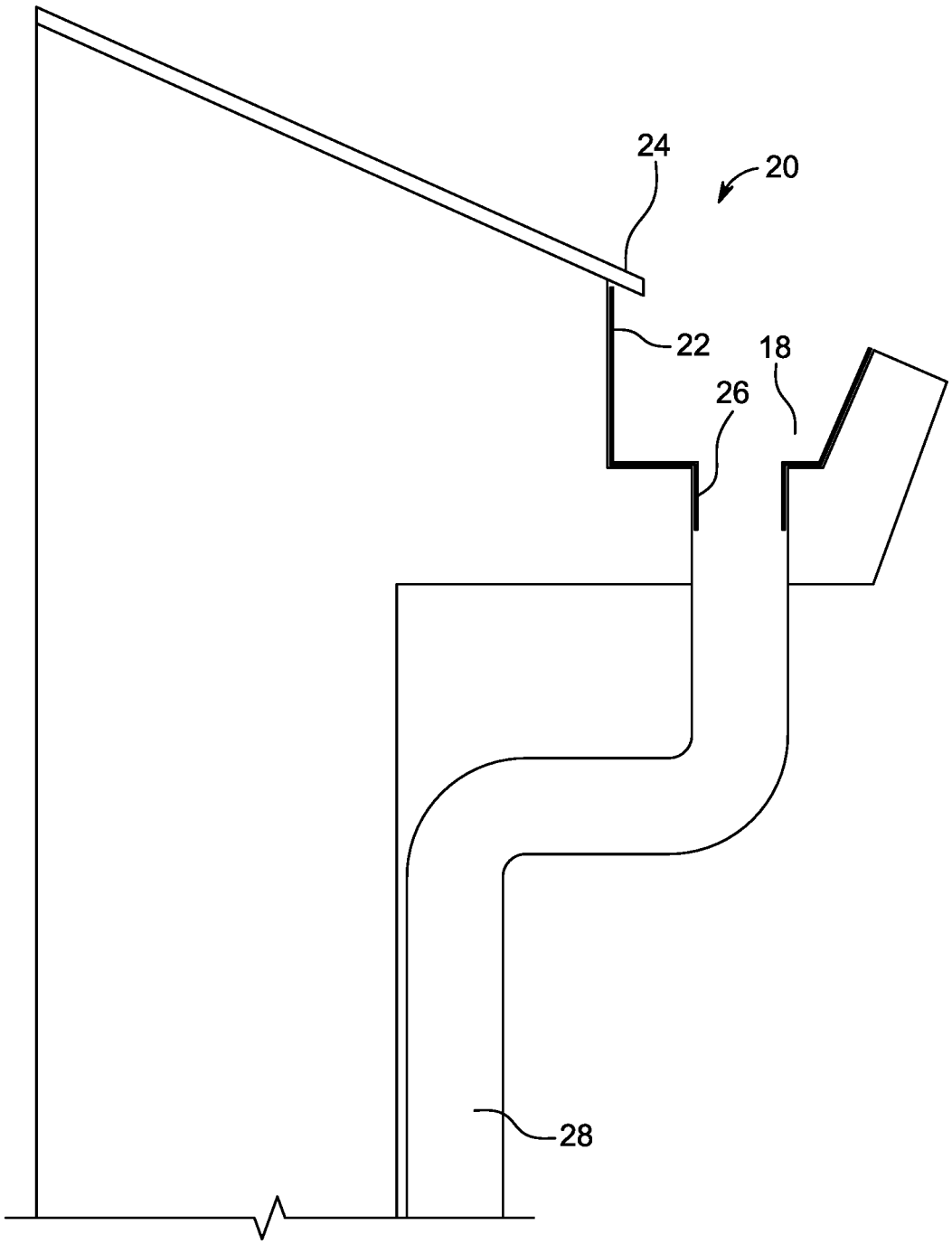
FIG. 4 schematically illustrates an exemplary built-in gutter system.
Figure 5:
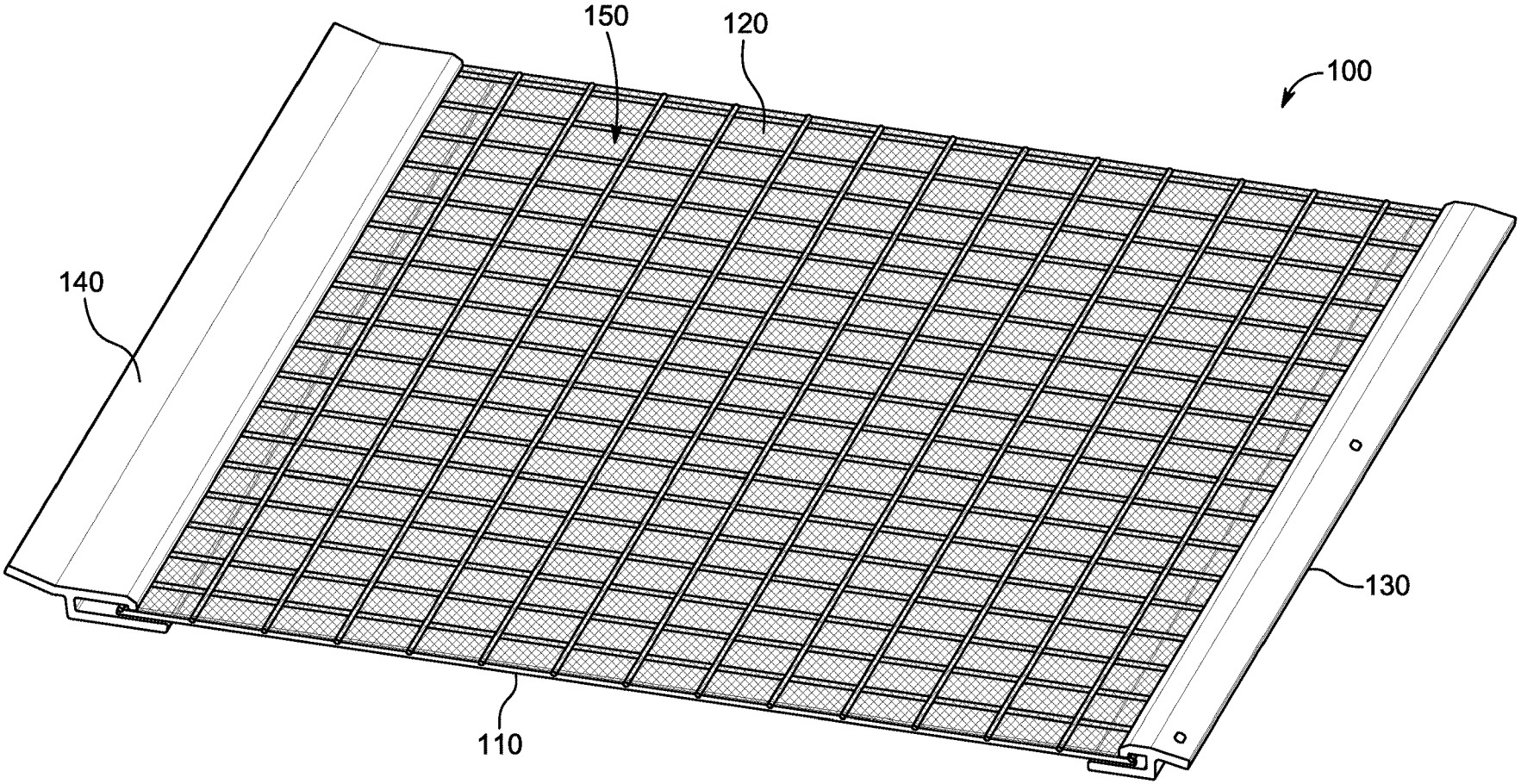
FIG. 5 schematically illustrates a perspective view of an exemplary gutter guard system assembly.
Figure 6:
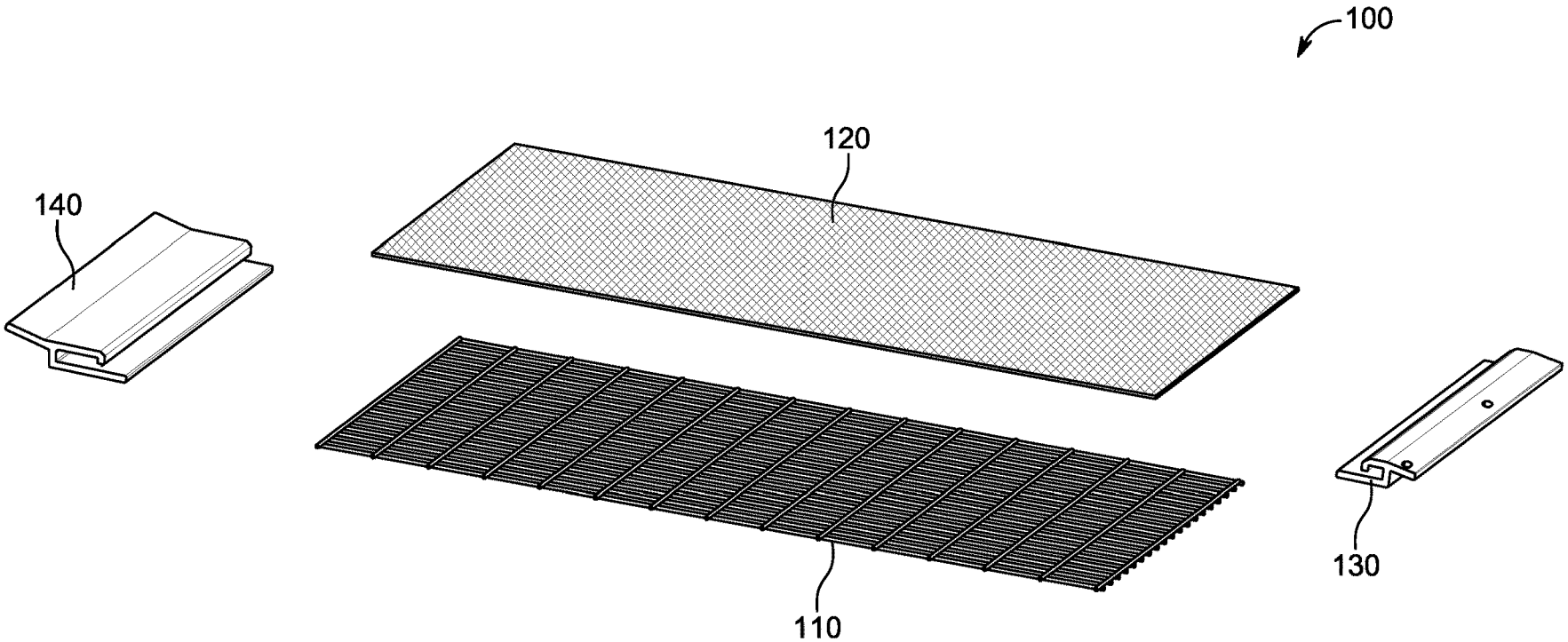
FIG. 6 schematically illustrates an exploded view the gutter guard system of FIG.

FIGS. 5 and 6 illustrate an exemplary gutter guard assembly 100. As noted, the gutter guard assembly 100 includes a main body 110, a mesh screen 120, a front receiver 130, and a rear receiver 140. When the gutter guard assembly 100 is assembled, the mesh screen 120 is positioned on top of the main body 110 to form a main body subassembly 150. A front receiver 130 is coupled to the front edge of the main body subassembly 150, and a rear receiver 140 is coupled to the rear edge of the main body subassembly 150.

Figure 7:
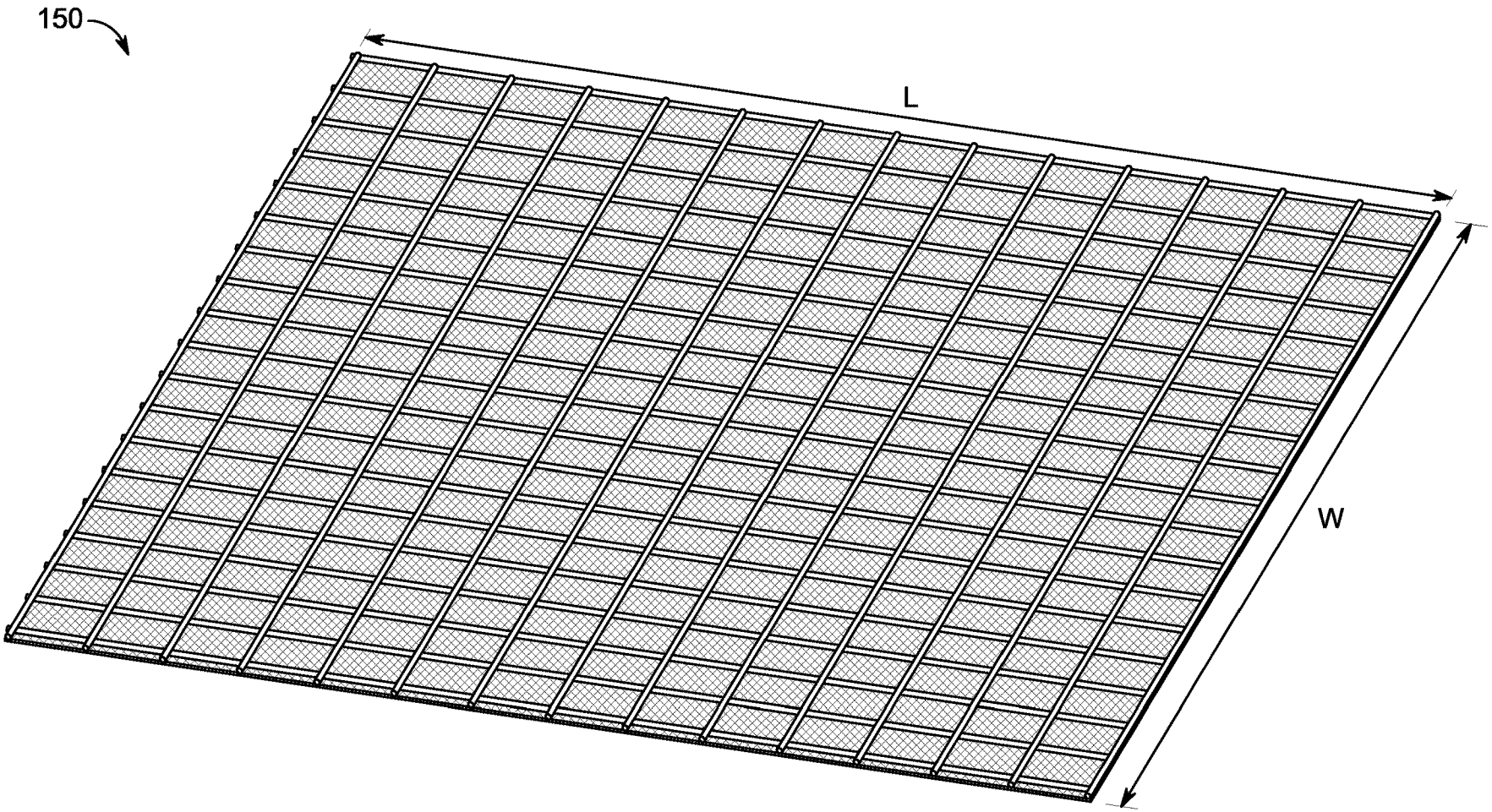
FIG. 7 schematically illustrates a perspective view of a main body and mesh screen assembly for use with the gutter guard system of FIG. 5.
Figure 8:
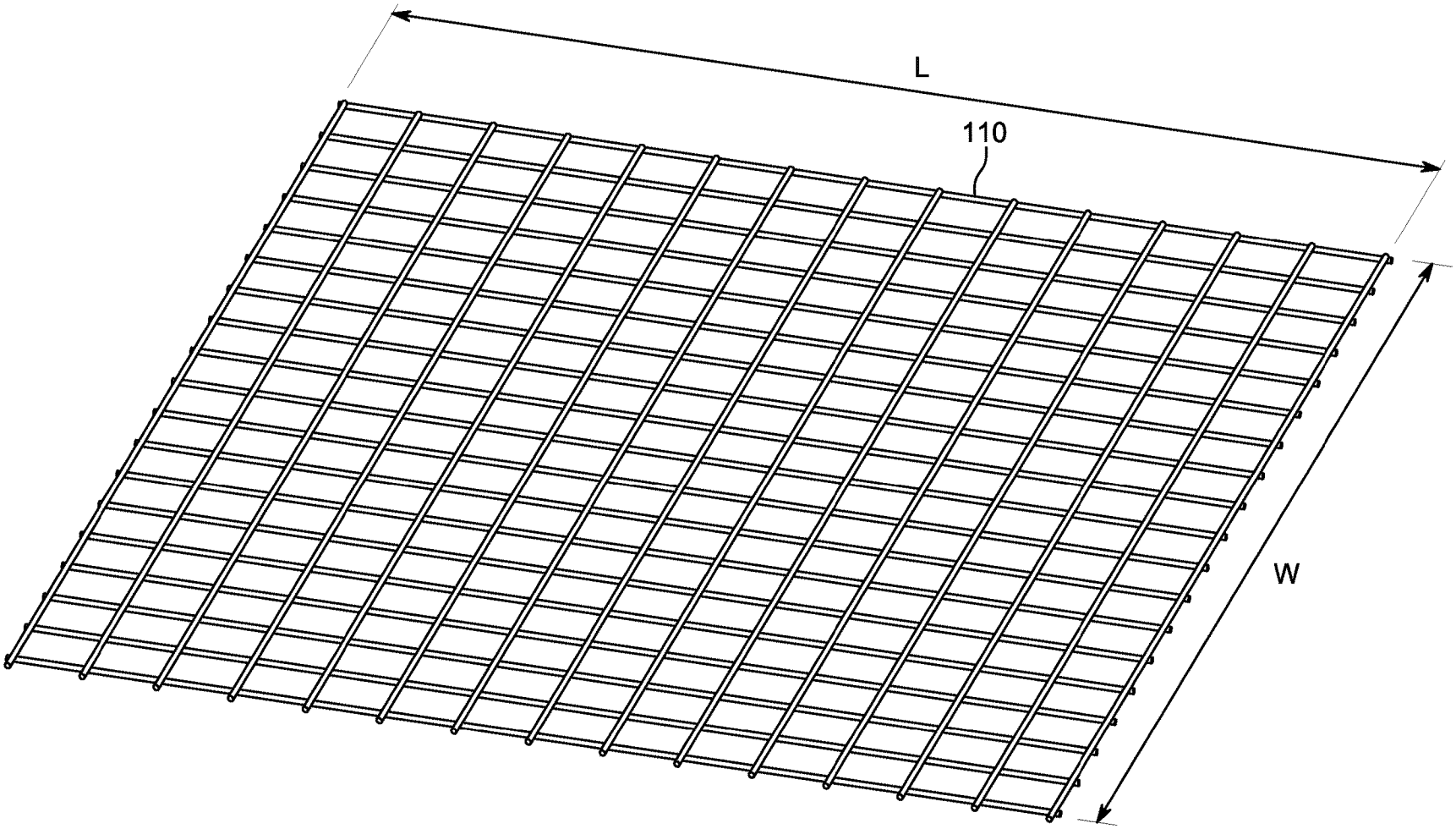
FIG. 8 schematically illustrates a perspective view of a main body for use with the gutter guard system of FIG. 5.

FIGS. 7 and 8 illustrate the main body subassembly 150 and main body 110, respectively. As illustrated in the figures, the main body subassembly 150 and main body 110 are generally flat and thin components with a width (W) and length (L). In the exemplary embodiment, the main body 110 is a series of thin metal rods welded together to form a lattice structure with the rods evenly spaced apart by approximately one inch along both the length (L) and width (W) of the main body 110. The structure of the main body 110 forms a support structure for the mesh screen 120 (which will be discussed subsequently). While the exemplary embodiment of the main body 110 is described as a series of thin metal rods welded together, it will be understood that other materials and arrangements can be used to achieve the functionality of forming a main body to support the mesh screen.

In the exemplary embodiment, the mesh screen 120 is a series of threads secured together to form a lattice structure with the threads evenly spaced apart along the width (W) and length (L) of the mesh screen 120. In one embodiment, the threads are made of 316L stainless steel wire with a diameter of 0.0085 inches. The wires are secured together through weaving and spaced evenly along the length (L) and width (W) such that there are approximately thirty threads per inch along both the length (L) and width (W) of the mesh screen 120. In such an arrangement, the surface area of the screen includes approximately 55% open area. The mesh screen 120 forms a structure that provides a plurality of openings for rainwater to pass through; however, at the same time creates a barrier that stops unwanted debris from passing through the mesh screen 120. While the exemplary embodiment of the mesh screen 120 is described as a specific metal wire woven together, it will be understood that other materials and arrangements can be used to achieve the functionality of forming a mesh screen that simultaneously allows rainwater to pass through the mesh screen and stops unwanted debris from passing through the mesh screen.

Figure 9:
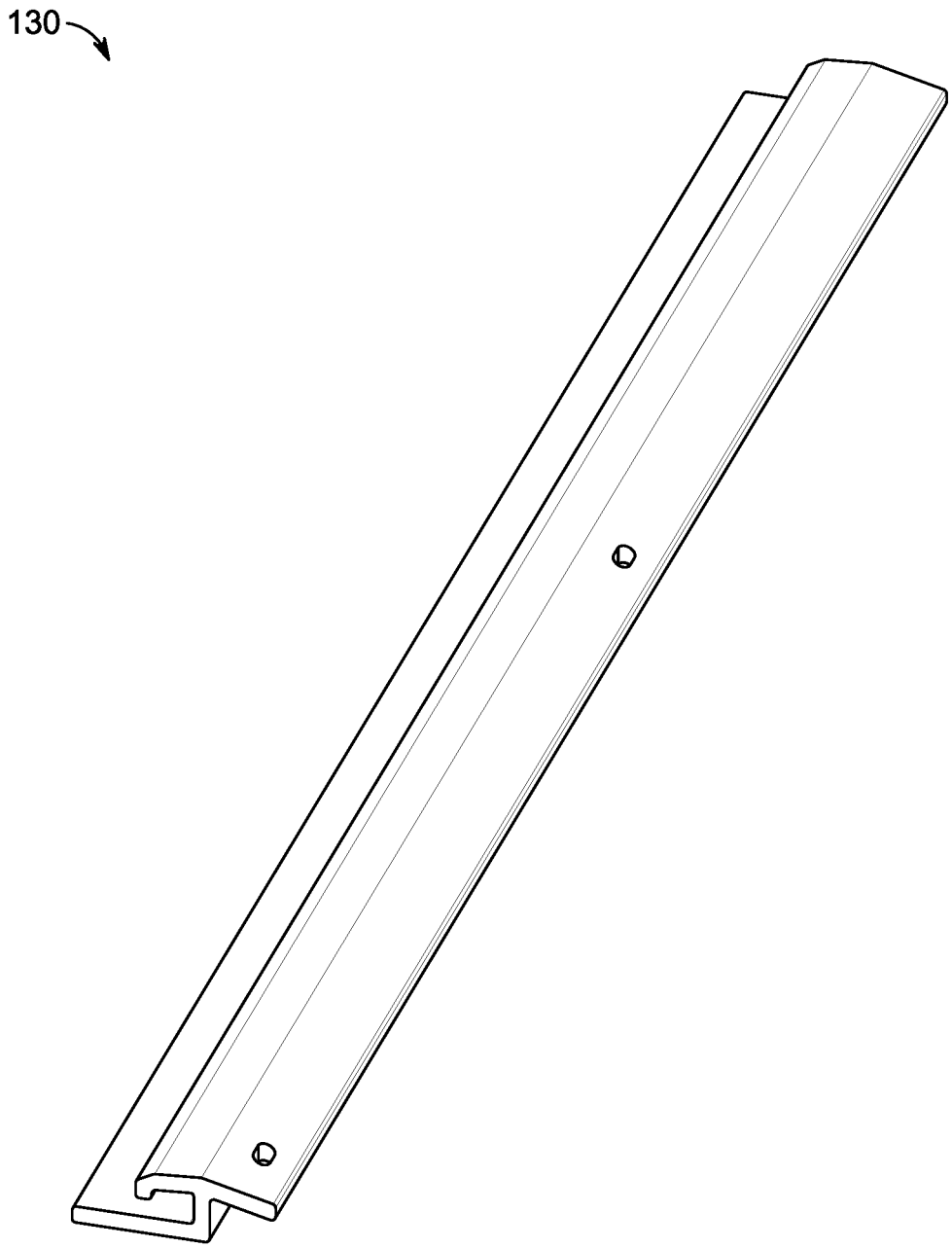
FIG. 9 schematically illustrates a perspective view of a front receiver for use with the gutter guard system of FIG. 5.
Figure 10:
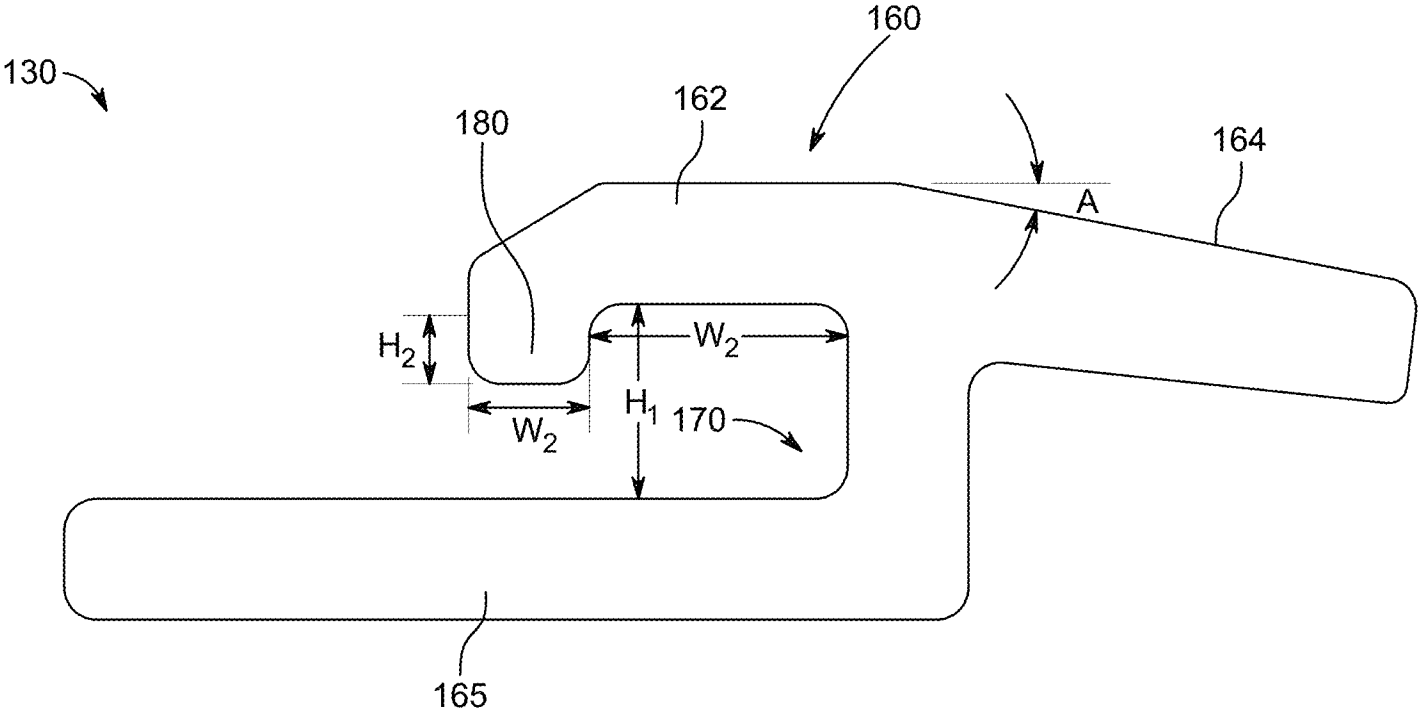
FIG. 10 schematically illustrates a side view of the front receiver of FIG. 9.

FIGS. 9 and 10 schematically illustrate an exemplary front receiver 130. The front receiver includes an extending front edge 160, lower front member 165, a channel 170 running along the length of the front receiver 130 between the extending front edge 160 and the lower front member 165, and a leg 180 extending downward from the extending front edge 160 toward the lower front member 165 and into the channel 170. The front receiver 130 can be coupled to the front edge of the main body assembly 150 by placing the front edge of the main body assembly 150 in the channel 170 of the front receiver 130. The front receiver 130 can be optionally secured to the main body assembly 150 though an adhesive, fastener, or other similar means. Conversely, the front receiver 130 can be reversibly coupled to the main body assembly 150 by sliding the front edge of the main body assembly 150 into the channel 170 of the front receiver, where the main body assembly 150 is secured through a friction fit within the channel 170 and the leg 180. In one embodiment, the width $W_1$ of the channel 170 allows the main body assembly 150 to be selectively positioned within the channel 170, which provides for variability in the overall width of the gutter guard system 100. Such variability in overall width is often helpful in accounting for inconsistencies in trough-style and built-in style gutter systems. In another embodiment, the channel 170 is sized such that the main body assembly 150 fits snuggly within the channel 170 and the relative position of the front receiver 130 and the main body assembly 150 is generally fixed. The front receiver 130 can be used to secure the gutter guard assembly 100 to a house or structure. For example, fasteners can be passed through the extending front edge 160 of the front receiver 130 and into the vertical walls 16 extending from the roofline. Such an arrangement will secure the gutter guard assembly 100 to the house or structure. The extending front edge 160 of the front receiver 130 is angled downward, which once secured to the house or structure, will encourage rainwater to flow over the extended from edge 160 and away from the roof.

In one embodiment, the front receiver 130 is arranged as follows. The extending front edge 160 is comprised of two sections—a straight section 162 and an angled section 164. The straight section 162 is arranged such that it is generally parallel with the lower front member 165, and parallel to the main body assembly 150 once the front receiver 130 is assembled with the main body assembly 150. The angled section 164 is positioned at an angle A that is approximately 16 degrees as compared to the straight section 162. In this embodiment, the width W1 of the channel is approximately 0.226 inches and the height H1 of the channel is approximately 0.200 inches. In this embodiment, the width W2 of the leg 180 is approximately 0.125 inches and the height H2 of the leg 180 is approximately 0.082 inches. It will be understood that such dimensions are exemplary only and can be altered to accommodate any number of varying main body assemblies.

Figure 11:
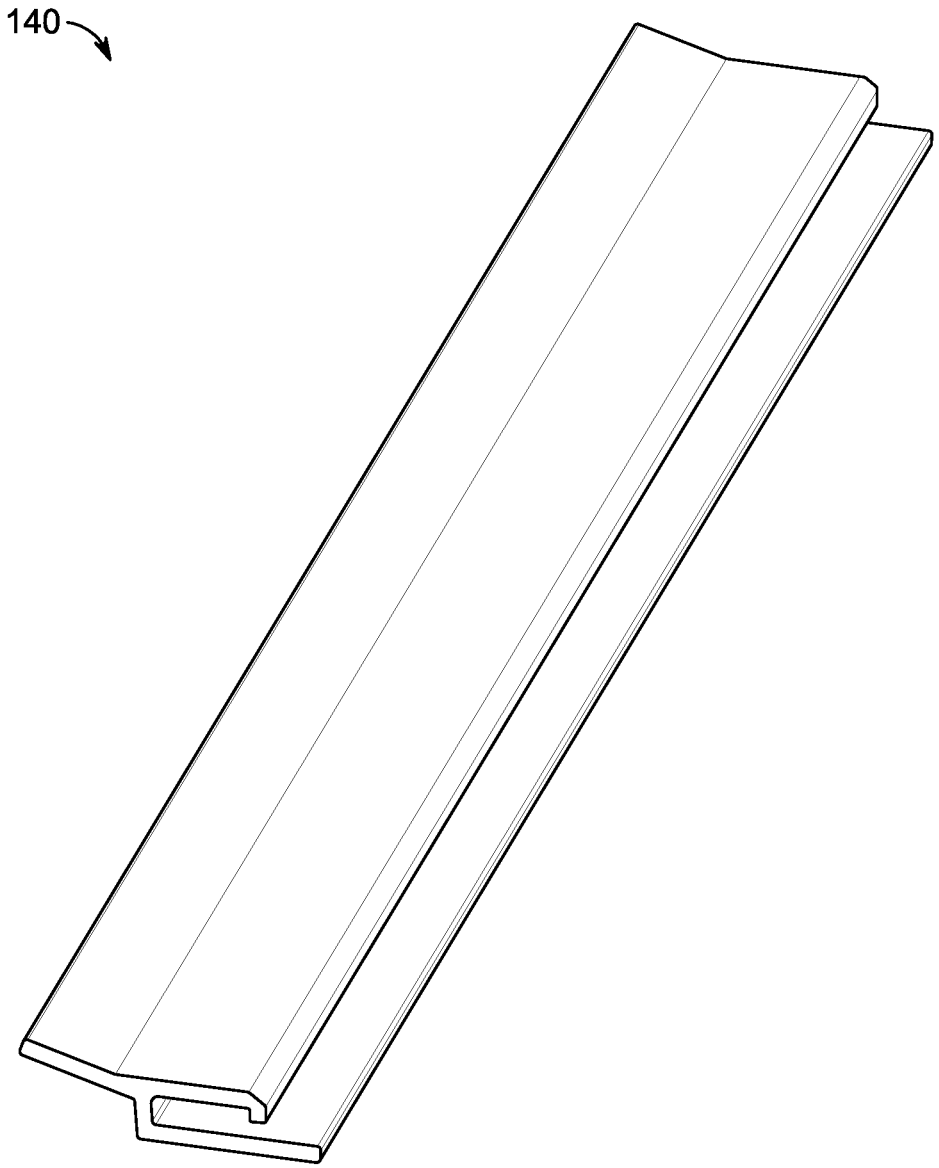
FIG. 11 schematically illustrates a perspective view of a rear receiver for use with the gutter guard system of FIG. 5.
Figure 12:
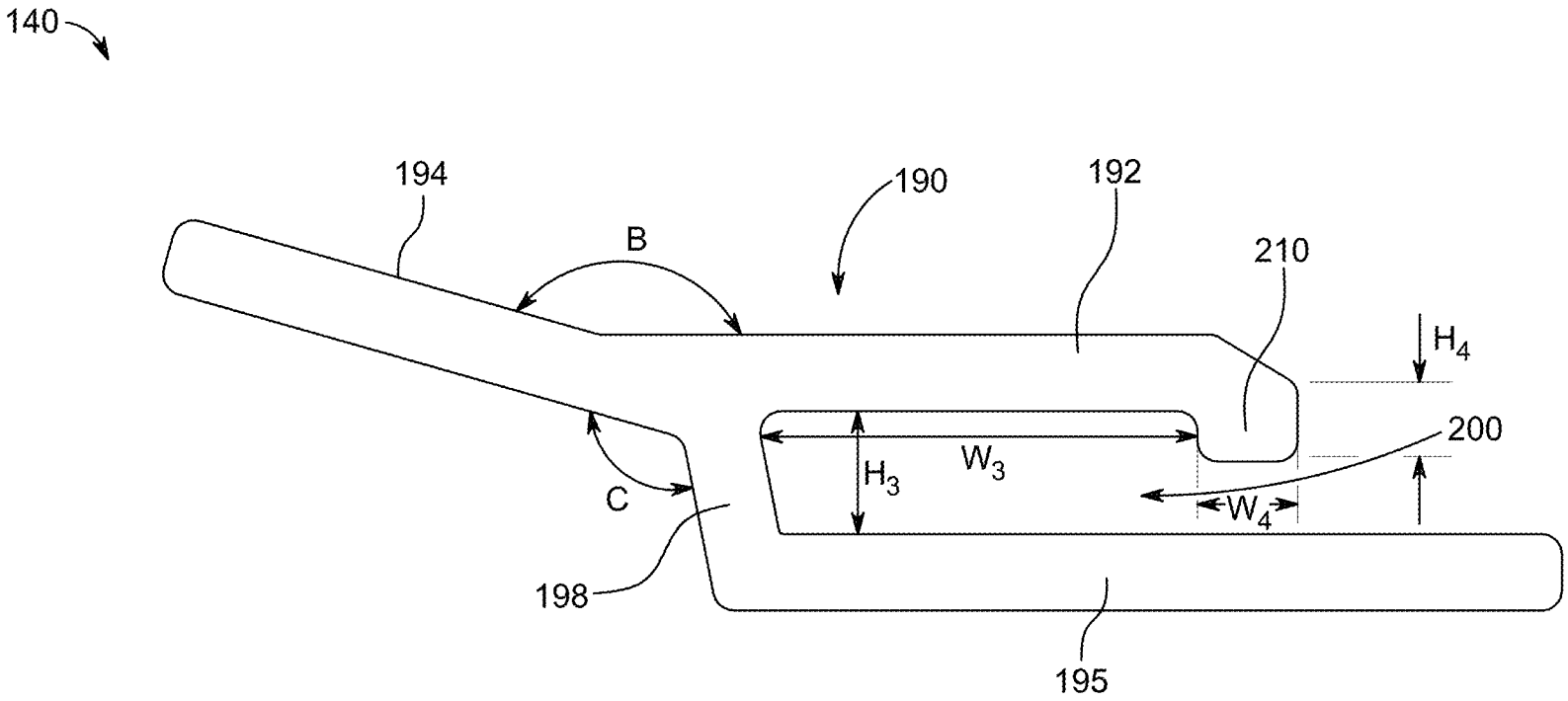
FIG. 12 schematically illustrates a side view of the rear receiver of FIG. 11.

FIGS. 11 and 12 schematically illustrate an exemplary rear receiver 140. The rear receiver 140 includes an extending rear edge 190, a lower rear member 195, a connection member 198 connecting the extending rear edge 190 and the lower rear member 195, a channel 200 running along the length of the rear receiver 140 between the extending rear edge 190, the lower rear member 195, and the connecting member 198, and a leg 210 extending downward from the extending rear edge 190 toward the lower rear member 195 and into the channel 210. The rear receiver 140 can be coupled to the rear edge of the main body assembly 150 by placing the rear edge of the main body assembly 150 in the channel 200 of the rear receiver 140. The rear receiver 140 can optionally be secured to the main body assembly 150 though an adhesive, fastener, or other similar means. Conversely, the rear receiver 140 can be reversibly coupled to the main body assembly 150 by sliding the rear edge of the main body assembly 150 into the channel 200 of the rear receiver 140, where the main body assembly 150 is secured through a friction fit within the channel 200 and the leg 210. Similar to the channel 170 of the front receiver 130, in one embodiment, the width $W_3$ of the channel 200 of the rear receiver 140 allows the main body assembly 150 to be selectively positioned within the channel 200, which provides for variability in the overall width of the gutter guard system 100. Such variability in overall width is often helpful in accounting for inconsistencies in trough-style and built-in style gutter systems. Furthermore, such selective positioning of the main body assembly 150 within the cannel 200 of the rear receiver 140 allows the main body 150 to be cut along any line running parallel to the rear receive 140 while still providing a friction fit within the channel 200 between the main body assembly 150 and the leg 210 of the rear receive 140. In another embodiment, the channel 200 is sized such that the main body assembly 150 fits snuggly within the channel 200 and the relative position of the rear receiver 140 and the main body assembly 150 is generally fixed. The rear receiver 140 can be used to secure the gutter guard assembly 100 to a house or structure. For example, the extending rear edge 190 of the rear receiver 140 can be positioned under the edge of the roofing material 14 to secure the gutter guard assembly 100 in place. Additionally, in another embodiment, fasteners can be passed through the extending rear edge 190 of the rear receiver 140 and into the roof. Such arrangements will secure the gutter guard assembly 100 to the house or structure. The extending rear edge 160 of the rear receiver 140 is angled downward, which once secured to the house or structure, will encourage rainwater to flow down the roof.

In one embodiment, the rear receiver 140 is arranged as follows. The extending rear edge 190 is comprised of two sections—a straight section 192 and an angled section 194. The straight section 192 is arranged such that it is generally parallel with the lower rear member 195, and parallel to the main body assembly 150 once the rear receiver 140 is assembled with the main body assembly 150. The angled section 194 is positioned at an angle B that is approximately 164 degrees as compared to the straight section 192. Additionally, the angle C between the angled section 194 and the connection member 198 is approximately 117 degrees. In this embodiment, the width $W_3$ of the channel is approximately 0.677 inches and the height $H_3$ of the channel is approximately 0.200 inches. In this embodiment, the width $W_4$ of the leg 210 is approximately 0.163 inches and the height $H_4$ of the leg 210 is approximately 0.082 inches. It will be understood that such dimensions are exemplary only and can be altered to accommodate any number of varying main body assemblies.

Figure 13:
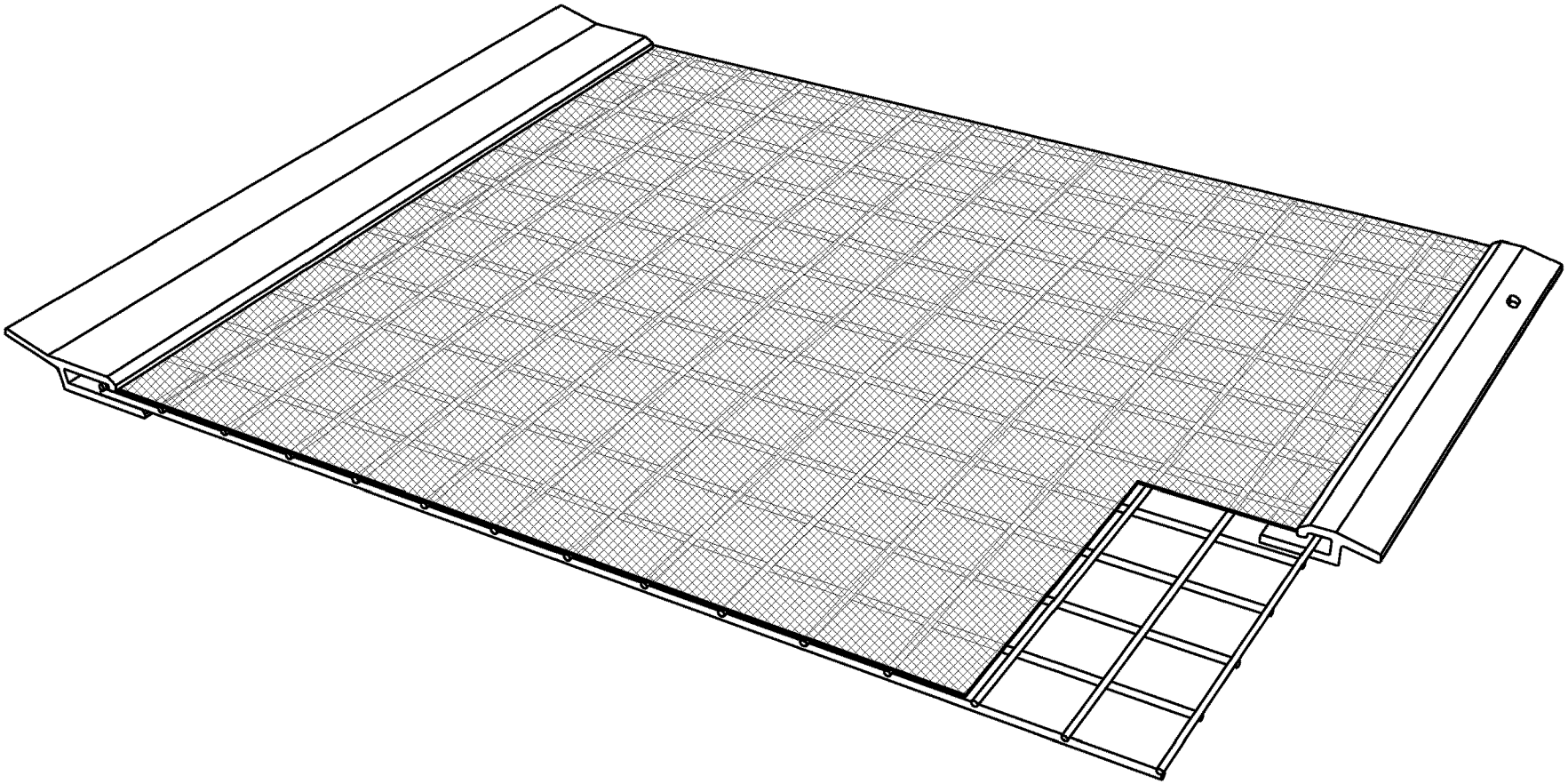
FIG. 13 schematically illustrates a perspective view of the gutter guard system of FIG. 5 with portions of the mesh screen and front receiver removed.

FIG. 13 schematically illustrates the gutter guard assembly 100 with a portion of the mesh screen 120 and front receiver 130 removed to better illustrate the assembly of the components.

The main body assembly 150 is arranged to be easily and quickly customized to accommodate the size and shape required to install the gutter guard assembly 100 over a trough-style or built-in gutter system. In one embodiment, the standard width (W) of the main body assembly 150 is approximately 15 inches. The standard length (L) of the main body assembly 150 can be five feet, eight feet, or any other length that is convenience to manufacture, ship, and work within the field. The standard width of 15 inches is greater than most if not all trough-style and built-in gutter system. However, because trough-style and built-in gutter system are custom designed and built, many have a width less than 15 inches. Thus, the standard width of the main body assembly 150 is too large. To address this issue, the main body assembly 150 is designed to be cut to custom size and shape using standard and available tools. FIGS. 14-18 illustrate two examples of cutting the main body assembly 150 to a custom size and shape.

Figure 14:
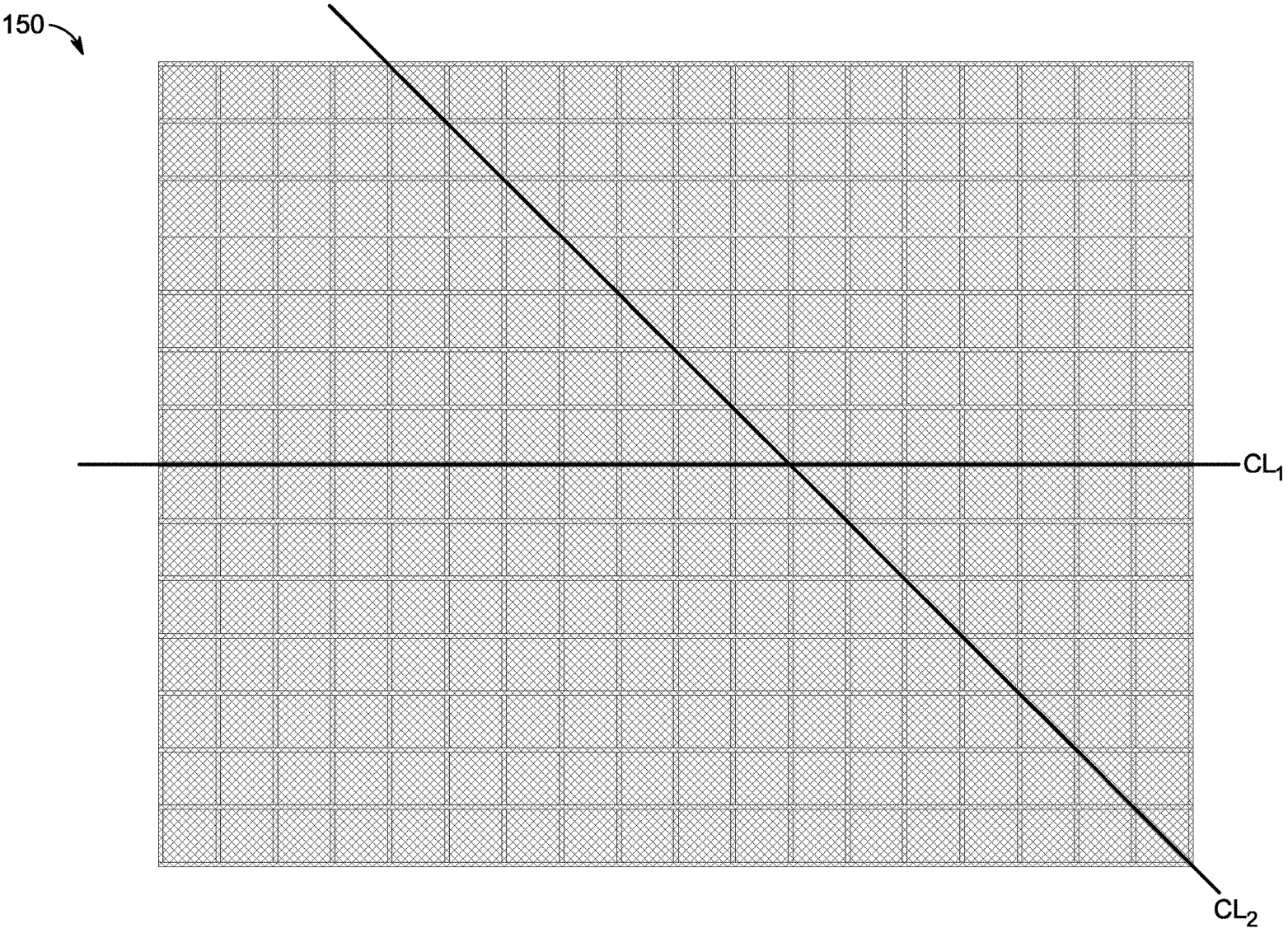
FIG. 14 schematically illustrates exemplary cut lines for customizing a main body assembly.
Figure 15:
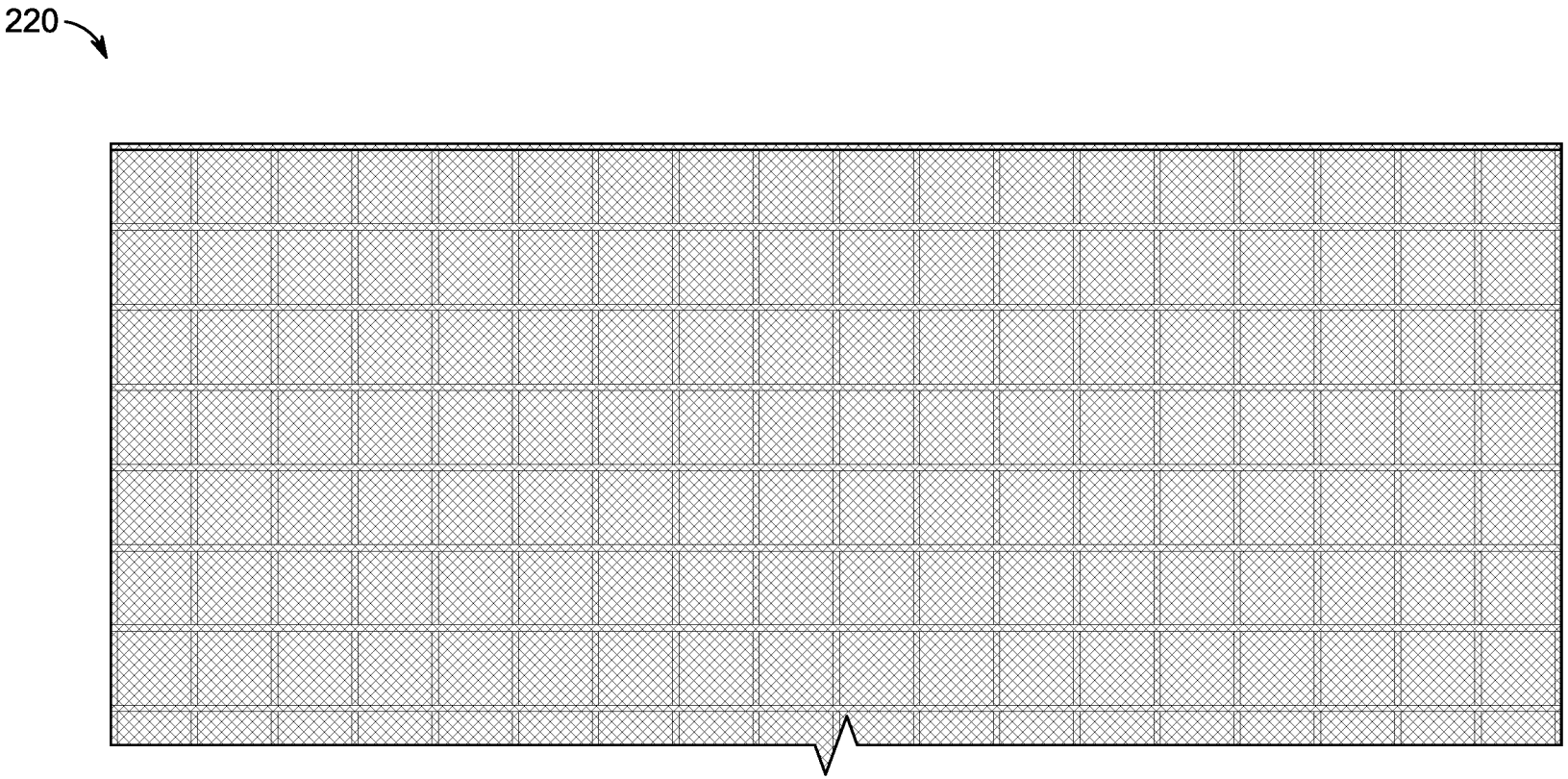
FIG. 15 schematically illustrates the resulting customized main body assembly when a cut is made along a cut line illustrated in FIG. 14.
Figure 16:
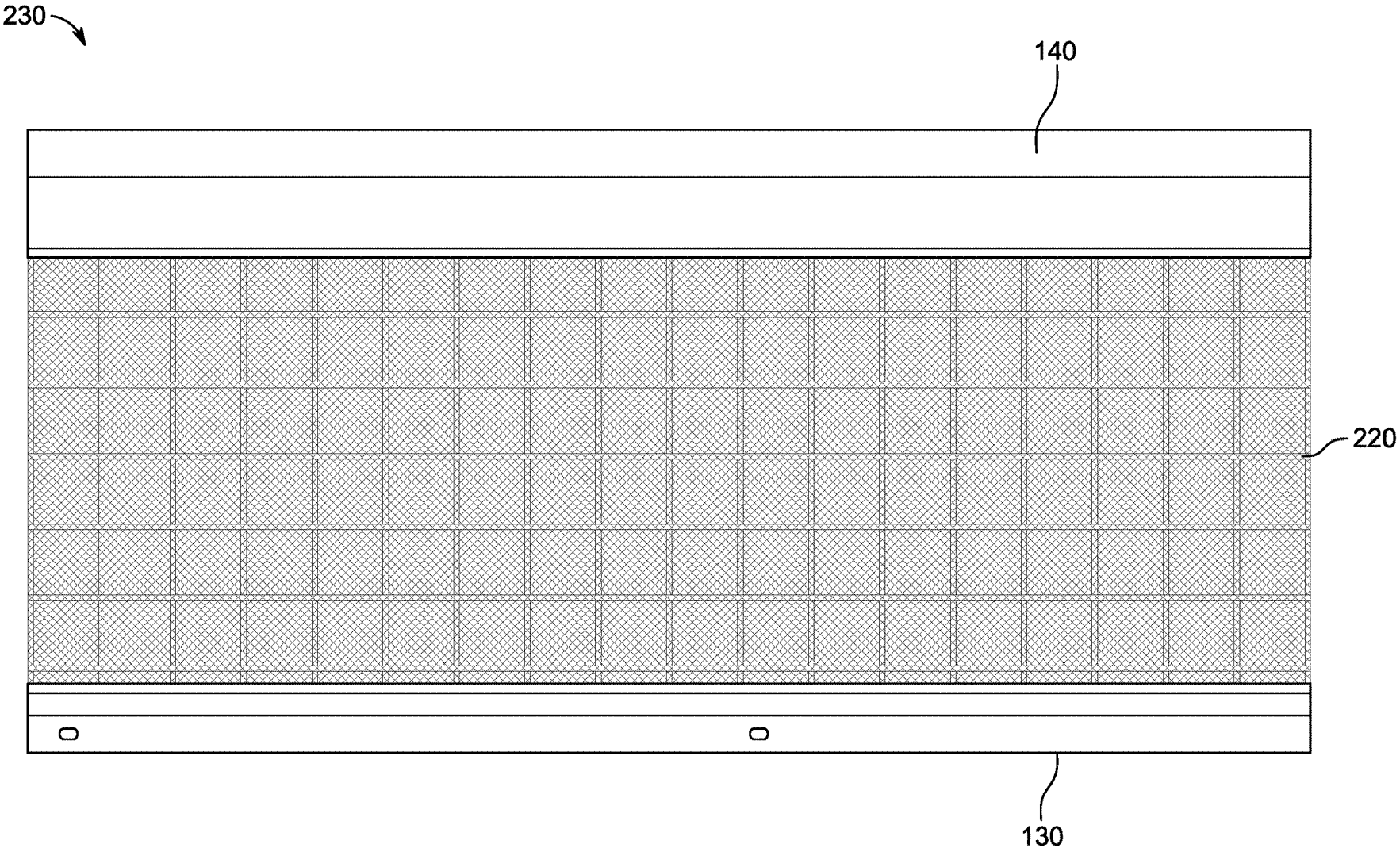
FIG. 16 schematically illustrates the resulting customized gutter guard assembly when using the customized main body assembly of FIG. 15.

As illustrated on FIG. 14, in one example, to accommodate a trough or box gutter that is approximately 7.5 inches in width, the main body assembly 150 can be cut along the cut line $CL_1$. Once cut along cut line $CL_1$, the result is a customized main body assembly 220, as schematically illustrated in FIG. 15. The standard front receiver 130 and rear receiver 140 can be coupled to the customized main body assembly 220, as illustrated in FIG. 16, to form a customized gutter guard assembly 230. The customized gutter guard assembly 230 can then be installed over the applicable trough-style or built-in gutter system. In one embodiment, the cut edge of the customized main body assembly 220 is inserted into the rear receiver 140, where the leg 210 of the rear receiver 140 can create a friction fit securing the customized main body assembly 220 within the rear receiver 140.

Figure 17:
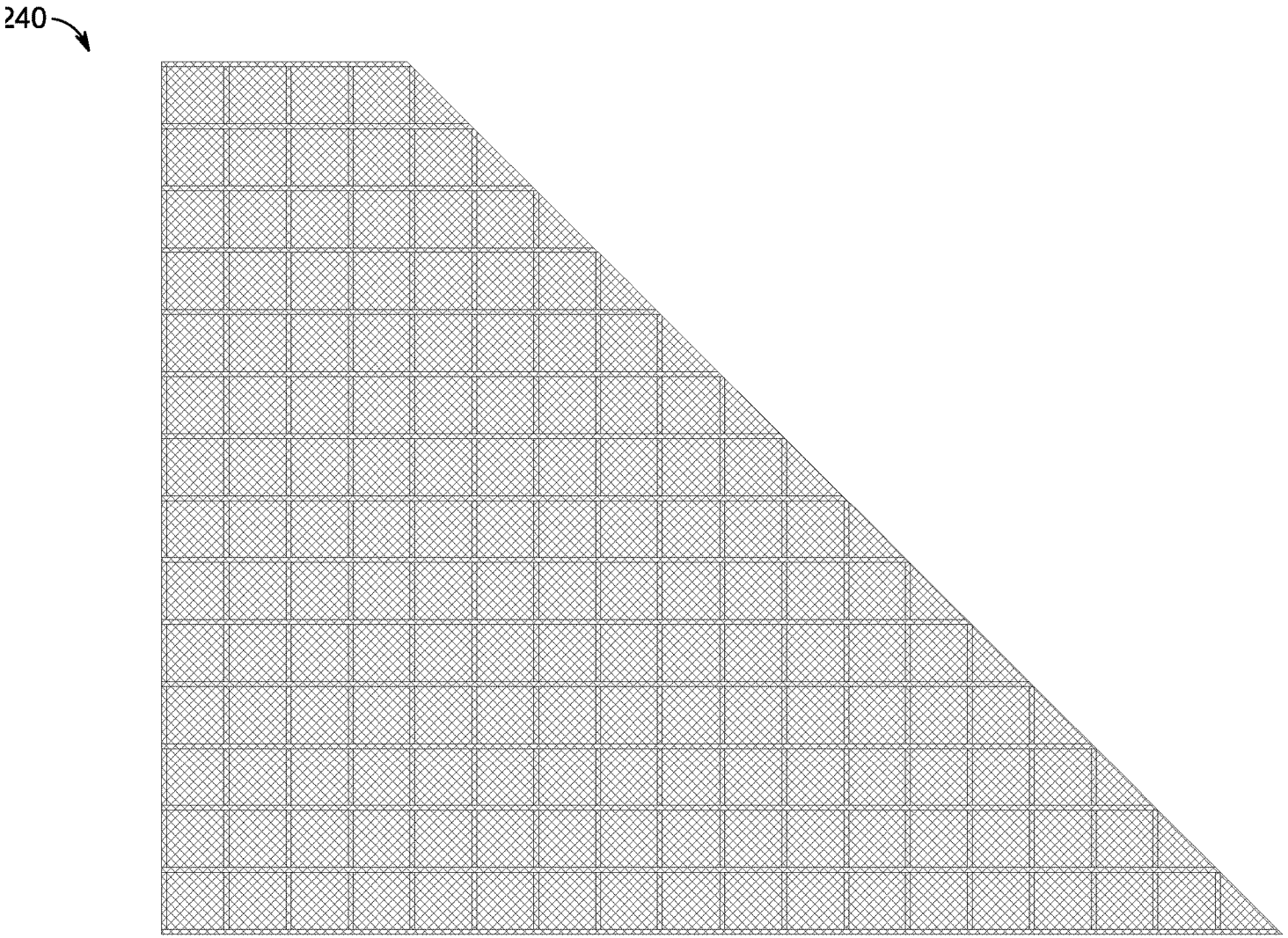
FIG. 17 schematically illustrates the resulting customized main body assembly when a cut is made along a cut line illustrated in FIG. 14.
Figure 18:
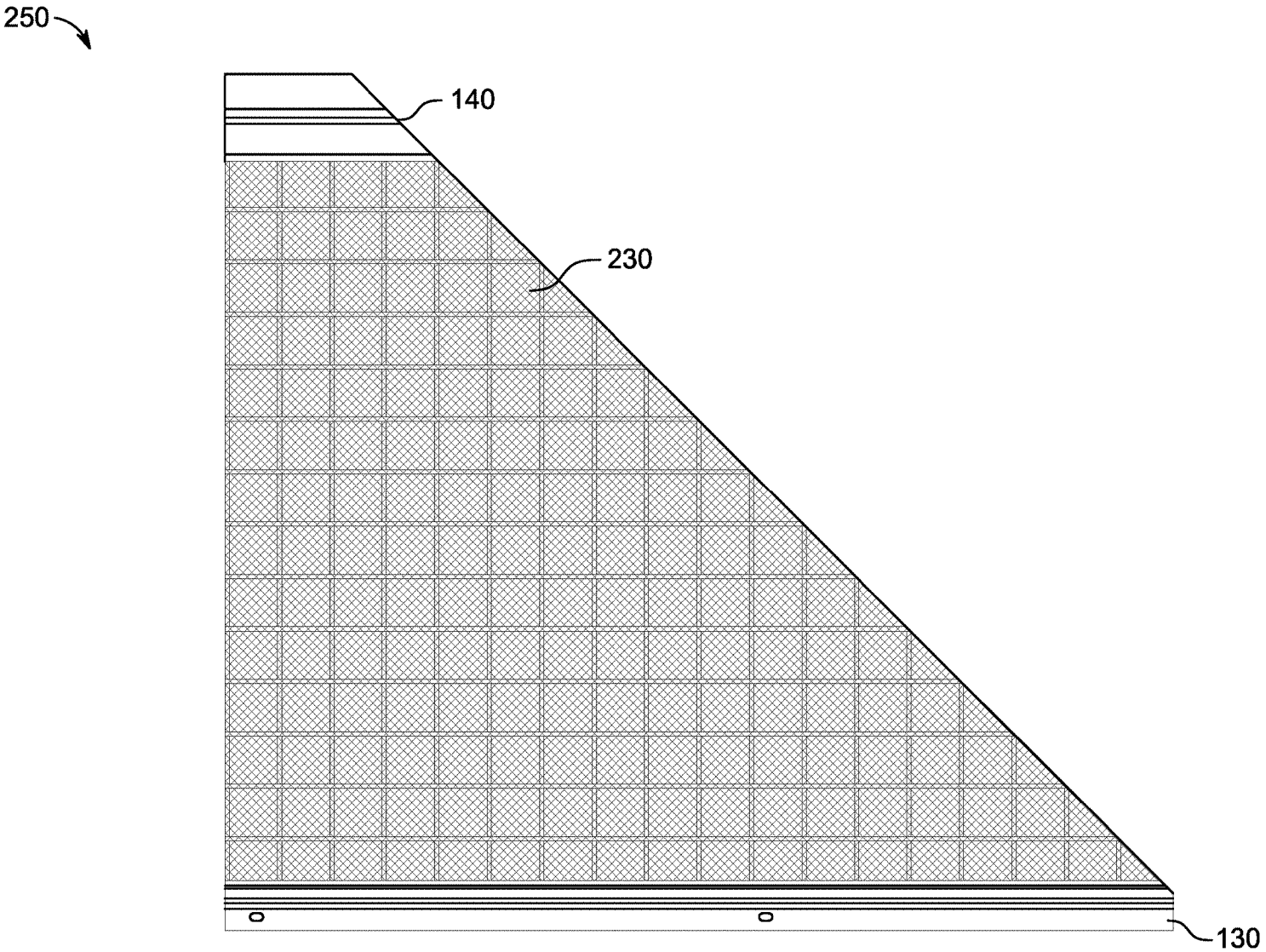
FIG. 18 schematically illustrates the resulting customized gutter guard assembly when using the customized main body assembly of FIG. 17.

FIG. 14 illustrates another example where the main body assembly 150 needs to be cut to accommodate a corner of a trough-style or box gutter system. As is further discussed herein, a diagonal cut is required to accommodate a miter joint that can be used to provide gutter guard protection at a corner of a home or structure. To achieve the necessary shape, the main body assembly 150 can be cut along the cut line $CL_2$. Once cut along cut line $CL_2$, the result is a customized main body assembly 240, as schematically illustrated in FIG. 17. A front receiver 130 and a rear receiver 140 can also be cut to accommodate the shape of the customized main body assembly 240, and the customized front receiver 130 and a rear receiver 140 can be coupled to the customized main body assembly 240, as illustrated in FIG. 18, to form a customized gutter guard assembly 250. The customized gutter guard assembly 250 can then be installed over the corner of the applicable trough-style or built-in gutter system. Such diagonal cuts can be used to accommodate both inside and outside corner arrangements. It will be understood that cuts can be made generally along both $CL_1$ and $CL_2$ to accommodate corner arrangements for specific widths of trough-style or built-in gutter system.

Figure 19:
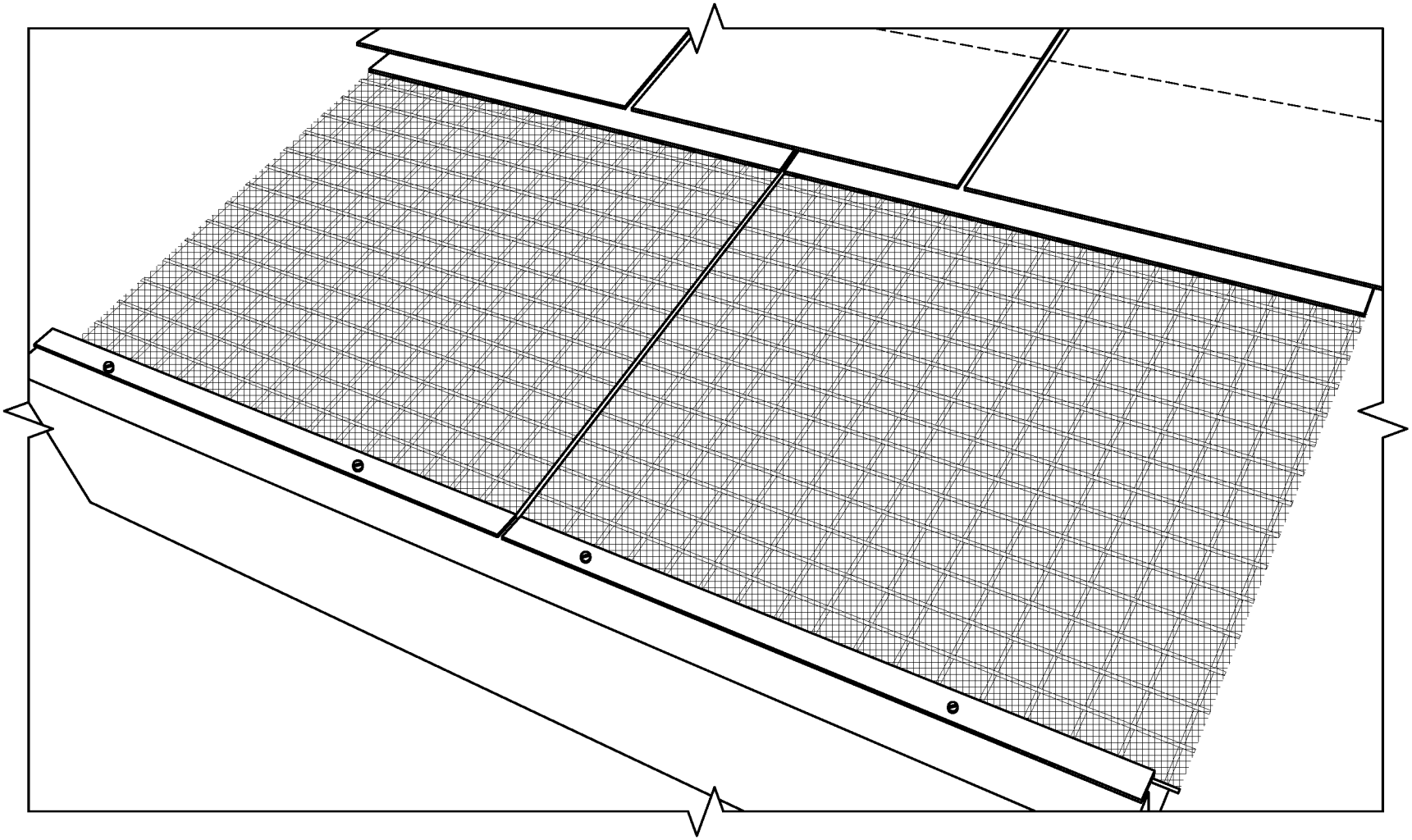
FIG. 19 is a photograph of a gutter guard system installed on a mock-up of a trough-style gutter system.
Figure 20:
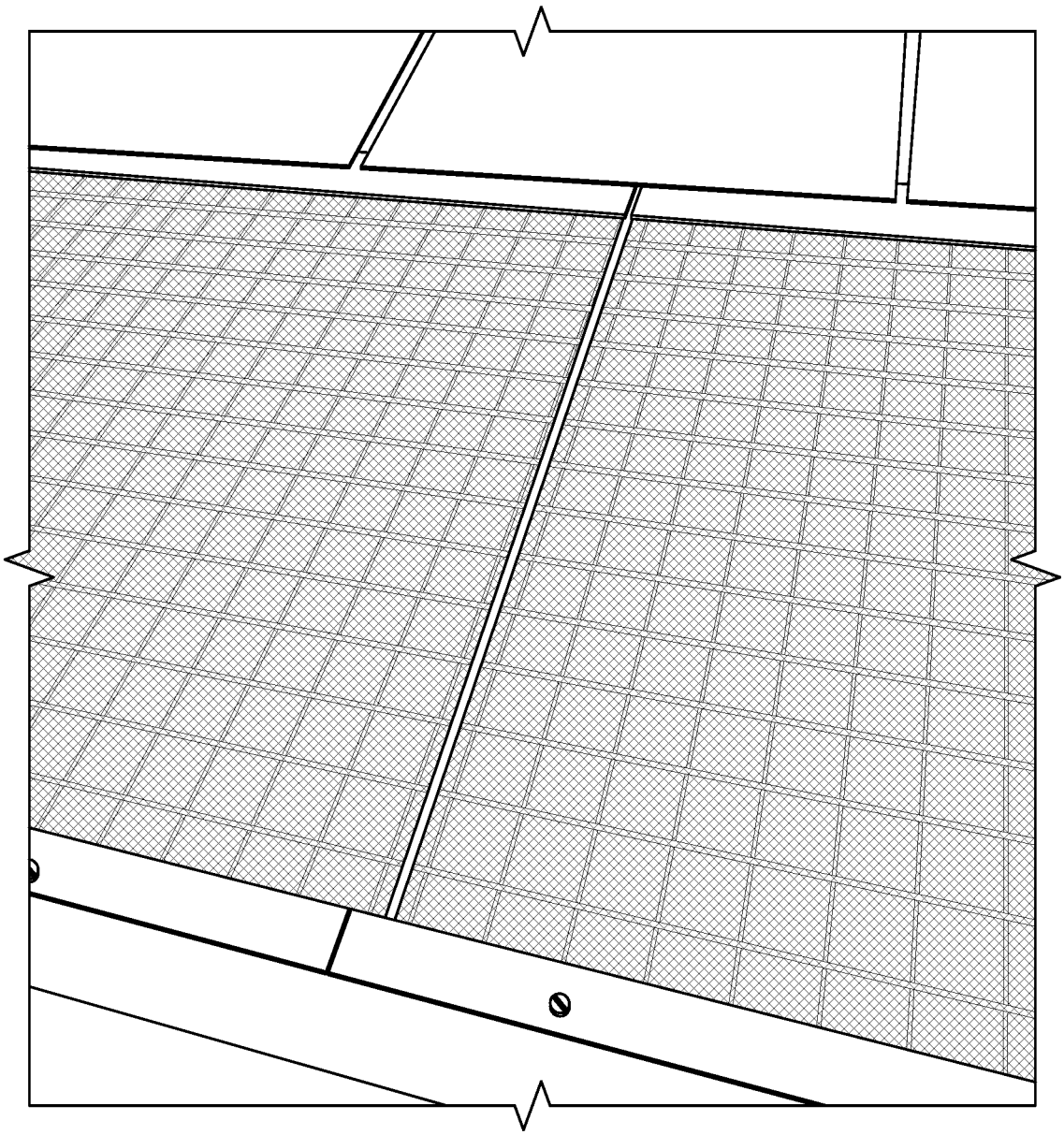
FIG. 20 is another photograph of a gutter guard system installed on a mock-up of a trough-style gutter system.
Figure 21:
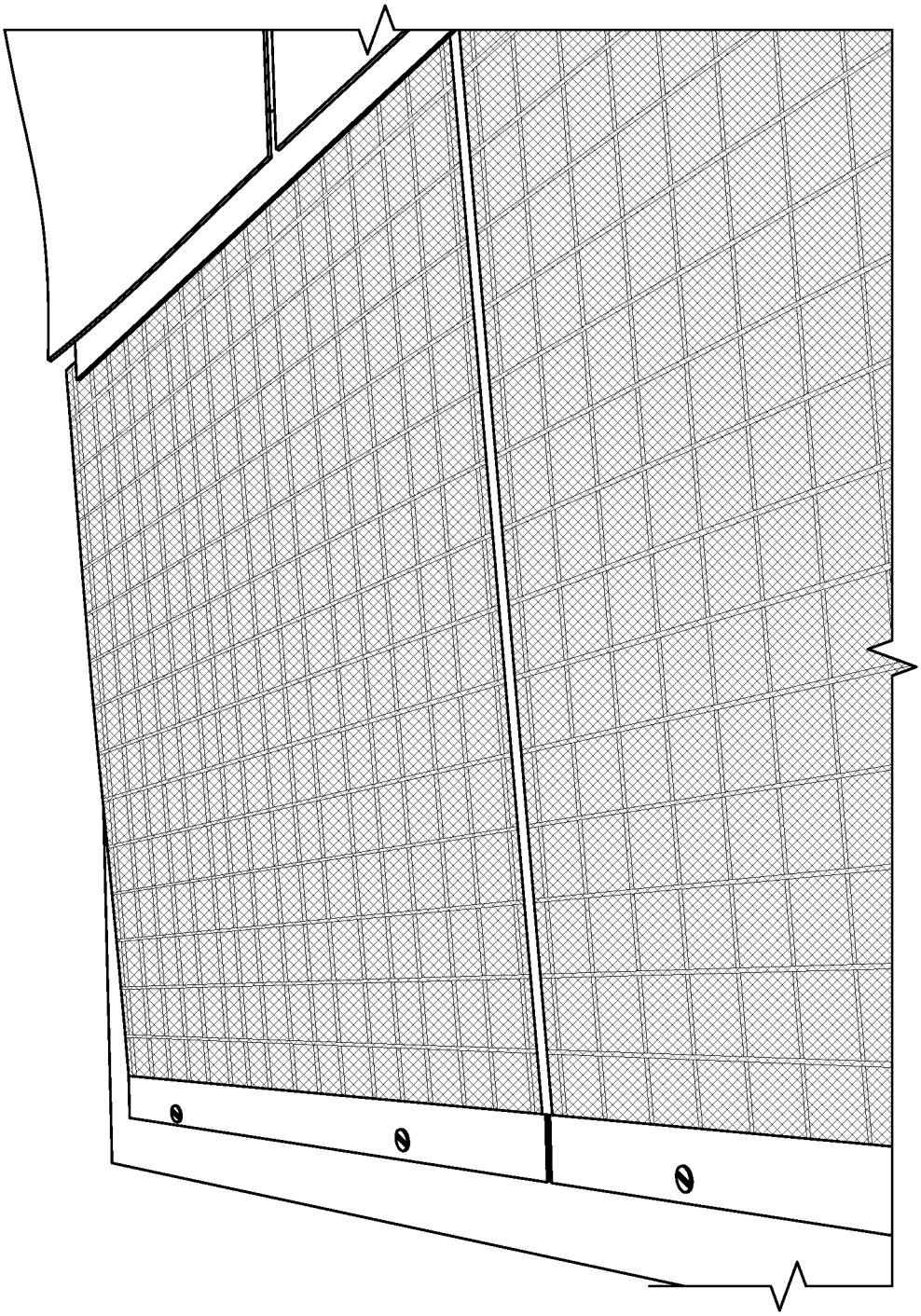
FIG. 21 is another photograph of a gutter guard system installed on a mock-up of a trough-style gutter system.

FIGS. 19-24 are photographs of various customized gutter guard assemblies installed on mockups of trough-style gutter systems. FIGS. 19-21 show two sections of a customized gutter guard system. The rear receiver of each section is positioned under the shingles of the roof, and the front receiver is secured to the roof with multiple fasteners. The two sections are joined with a butt joint so that there are no gaps in the overall customized gutter guard system.

Figure 22:
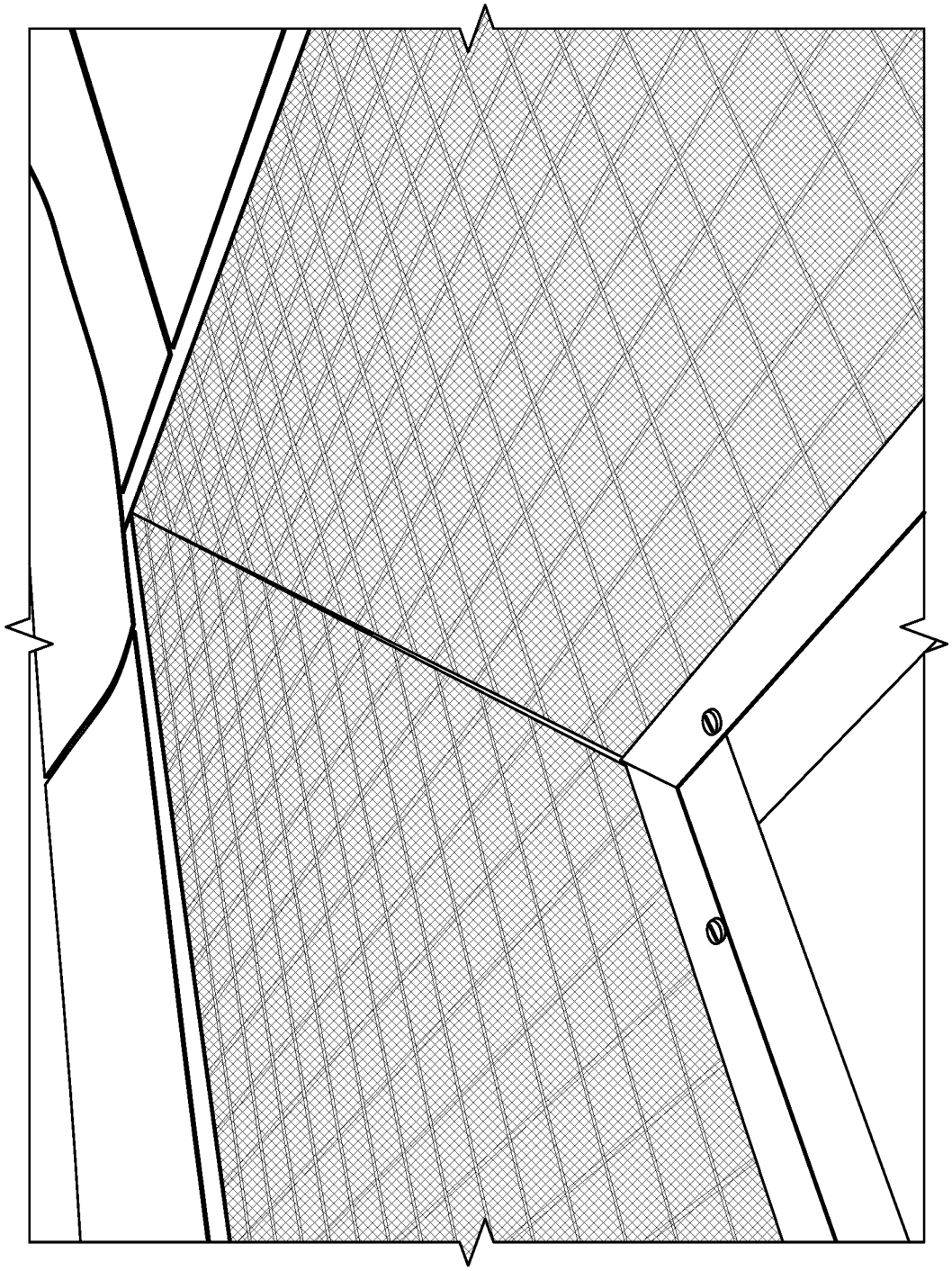
FIG. 22 is a photograph of a gutter guard system installed on a mock-up of a trough-style gutter demonstrating installation at a corner using a miter joint.
Figure 23:
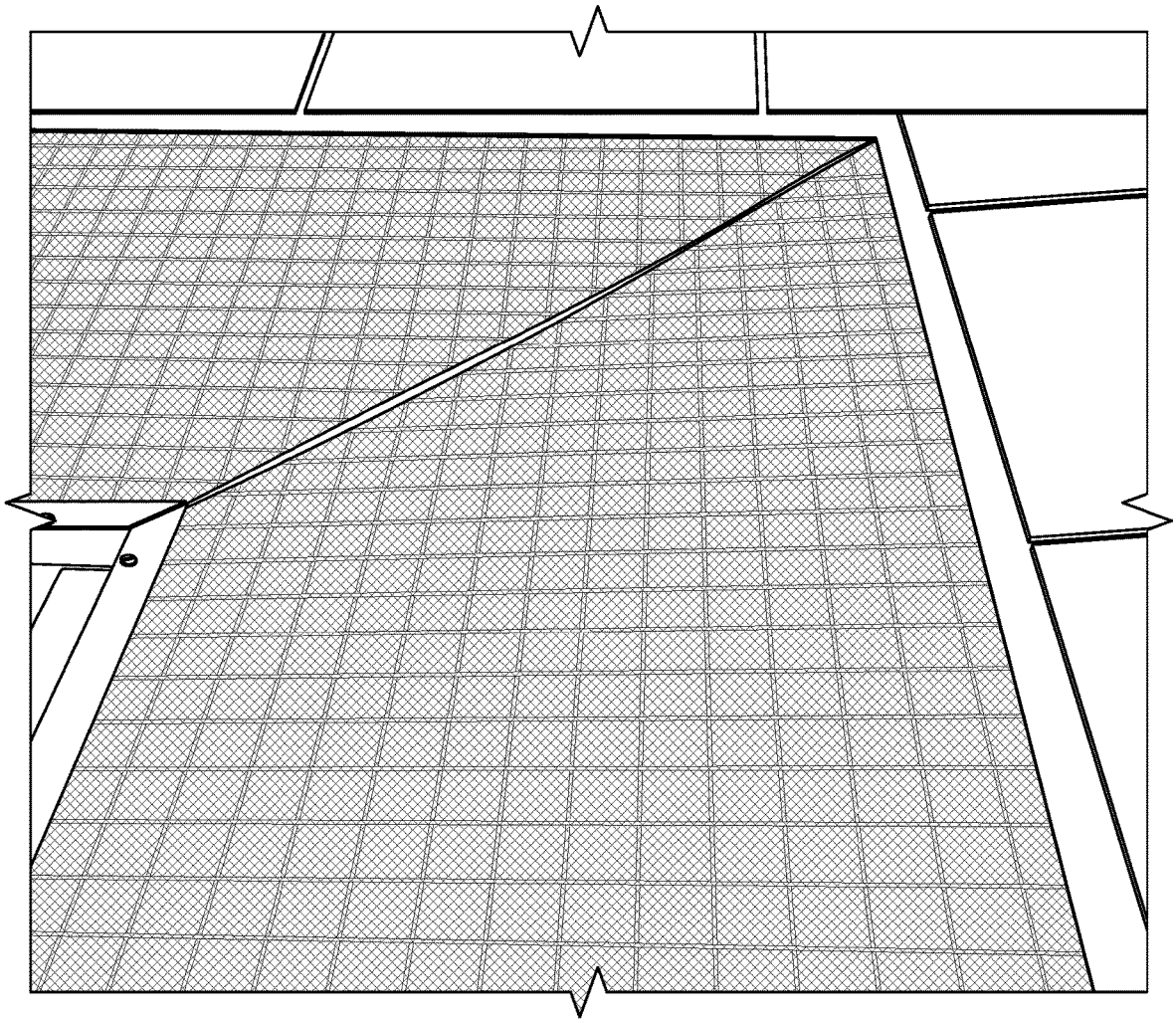
FIG. 23 is another photograph of a gutter guard system installed on a mock-up of a trough-style gutter demonstrating installation at a corner using a miter joint.

FIGS. 22 and 23 show a pair of matching sections of a customized gutter guard system that combine to provide protection at an inside corner of a trough-style gutter system. Each section includes a diagonal cut that join together to form a miter joint. The front and rear receivers are also trimmed to accommodate the diagonal cut of the main body assembly. The rear receiver of each section is positioned under the shingles of the roof, and the front receiver is secured to the roof with multiple fasteners.

Figure 24:
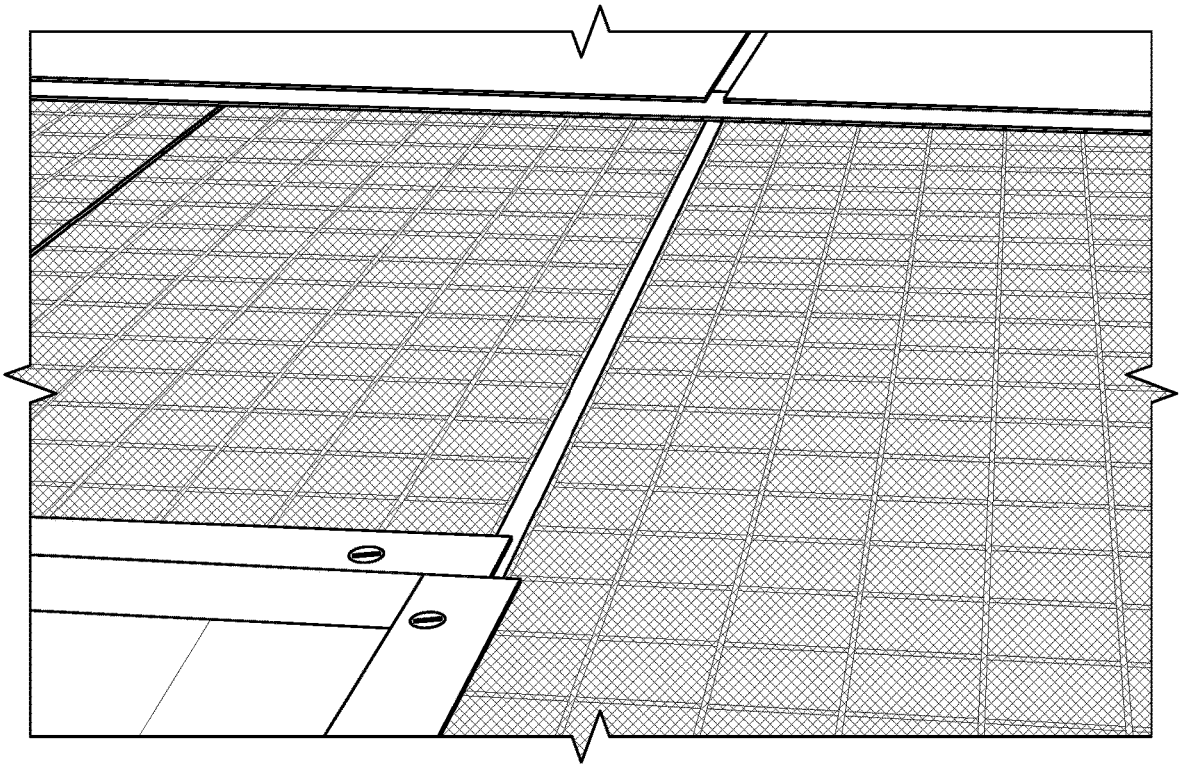
FIG. 24 is a photograph of a gutter guard system installed on a mock-up of a trough-style gutter demonstrating installation at a corner using a butt joint.

FIG. 24 shows a pair of matching sections of a customized gutter guard system that combine to provide protection at an inside corner of a trough-style gutter system. However, in this example, the sections join together to form a butt joint. The rear receiver of each section is positioned under the shingles of the roof, and the front receivers are secured to the roof with fasteners.

The foregoing description of examples has been presented for purposes of illustration and description. It is not intended to be exhaustive or limiting to the forms described. Numerous modifications are possible in light of the above teachings. Some of those modifications have been discussed, and others will be understood by those skilled in the art. The examples were chosen and described in order to best illustrate principles of various examples as are suited to particular uses contemplated. The scope is, of course, not limited to the examples set forth herein, but can be employed in any number of applications and equivalent devices by those of ordinary skill in the art.

What is claimed is:

1. A gutter guard system comprising:

a customizable main body arranged to be trimmed to custom dimensions, the main body including a top surface, a bottom surface, a front edge, and a rear edge;

a mesh screen positioned on the top surface of the main body;

a front receiver comprising:

an upper member including a front end and a rear end running the length of the front receiver;

a lower member including a front end and a rear end running the length of the front receiver;

a connecting member connecting the upper member and the front end of the lower member;

a leg extending downward from the rear end of the upper member toward the lower member; and a channel formed by the upper member, lower member, connecting member, and the leg, wherein the front edge of the main body is positioned in the channel; and a rear receiver positioned along the rear edge of the main body.

2. The gutter guard system of claim 1, wherein the main body comprises a plurality of metal rods arranged in a lattice structure.

3. The gutter guard system of claim 2, wherein the metal rods are welded together and spaced approximately one inch apart.

4. The gutter guard system of claim 1, wherein the mesh screen comprises a plurality of threads woven into a lattice structure.

5. The gutter guard system of claim 4, wherein the threads are comprised of 316L stainless steel wire with a diameter of approximately 0.0085 inches.

6. The gutter guard system of claim 5, wherein threads are arranged such that there are approximately 30 threads per linear inch in both directions of the lattice.

7. The gutter guard system of claim 4, wherein the threads are arranged so that the open cross-sectional area of the mesh screen is approximately fifty-five percent.

8. The gutter guard system of claim 1, wherein the front edge of the main body is engaged in a friction fit with the channel.

9. The gutter guard system of claim 8, wherein the channel is arranged such that the positioning of the front edge of the main body in the channel is variable.

10. The gutter guard system of claim 1, wherein the upper member comprises a forward section extending from the intersection of the connecting member and the upper member to the front end of the upper member and a rearward section extending from the intersection of the connecting member and the upper member to the rear end of the upper member, wherein the forward section extends at a downward angle from the rearward section.

11. A gutter guard system comprising:

a customizable main body arranged to be trimmed to custom dimensions, the main body including a top surface, a bottom surface, a front edge, and a rear edge;

a mesh screen positioned on the top surface of the main body;

a front receiver positioned along the front edge of the main body; and a rear receiver comprising:

an upper member including a front end and a rear end running the length of the rear receiver;

a lower member including a front end and a rear end running the length of the rear receiver;

a connecting member connection the upper member and the rear end of the lower member;

a leg extending downward from the front end of the upper member toward the lower member; and a channel formed by the upper member, lower member, connection member, and the leg, wherein the rear edge of the main body is positioned in the channel.

12. The gutter guard system of claim 1, wherein the rear edge of the main body is engaged in a friction fit with the channel.

13. The gutter guard system of claim 12, wherein the channel is arranged such that the positioning of the rear edge of the main body in the channel is variable.

14. The gutter guard system of claim 11, wherein the upper member comprises a forward section extending from the intersection of the connecting member and the upper member to the front end of the upper member and a rearward section extending from the intersection of the connection member and the upper member to the rear end of the upper member, wherein the rearward section extends at an upward angle from the forward section.

15. The gutter guard system of claim 1, wherein the dimensions of the gutter guard system can be customized by trimming the main body along a line that is generally parallel to the front edge and rear edge of the main body.

16. The gutter guard system of claim 1, wherein the dimensions of the gutter guard system can be customized by trimming the main body along a line that is generally at an angle to the front edge and rear edge of the main body.

17. The gutter guard system of claim 16, wherein the angle is generally forty-five degrees with reference to the front edge and rear edge of the main body.

18. The gutter guard system of claim 1, wherein the rear receiver comprises:

an upper member running the length of the rear receiver;

a lower member running the length of the rear receiver;

a connecting member connecting the upper member and lower member;

and a leg extending downward from the upper member toward the lower member; and a channel formed by the upper member, lower member, connecting member, and the leg.

19. The gutter guard system of claim 1, wherein the width of the channel of the front receiver is approximately 0.226 inches.

20. The gutter guard system of claim 1, wherein the height of the channel of the front receiver is approximately 0.200 inches.

21. The gutter guard system of claim 1, wherein the leg extends downward toward the lower member at about the midpoint of the lower member.

22. The gutter guard system of claim 1, wherein the height of the leg is approximately 0.082 inches and the width of the leg is approximately 0.125 inches.

23. The gutter guard system of claim 11, wherein the width of the channel of the rear receiver is approximately 0.677 inches.

24. The gutter guard system of claim 11, wherein the height of the channel of the front receiver is approximately 0.200 inches.

25. The gutter guard system of claim 11, wherein the leg extends downward toward the lower member at a point nearer to the front end of the lower member than to the rear end of the lower member.

26. The gutter guard system of claim 1, wherein the height of the leg is approximately 0.082 inches and the width of the leg is approximately 0.163 inches.

27. A gutter guard system comprising:

a customizable main body arranged to be trimmed to custom dimensions, the main body including a top surface, a bottom surface, a front edge, and a rear edge;

a mesh screen positioned on the top surface of the main body;

a front receiver front receiver comprising:

an upper member including a front end and a rear end running the length of the front receiver;

a lower member including a front end and a rear end running the length of the front receiver;

a connecting member connecting the upper member and the front end of the lower member; and a leg extending downward from the rear end of the upper member toward the lower member; and a channel formed by the upper member, lower member, connecting member, and the leg, wherein the front edge of the main body is positioned in the channel; and a rear receiver comprising:

an upper member including a front end and a rear end running the length of the rear receiver;

a lower member including a front end and a rear end running the length of the rear receiver;

a connecting member connection the upper member and the rear end of the lower member;

a leg extending downward from the front end of the upper member toward the lower member; and a channel formed by the upper member, lower member, connection member, and the leg, wherein the rear edge of the main body is positioned in the channel.

* * * * *